US009360825B2

(12) United States Patent
Kakuta et al.

(10) Patent No.: US 9,360,825 B2
(45) Date of Patent: Jun. 7, 2016

(54) CLEANING DEVICE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Hideki Kakuta, Suntou-gun (JP); Kazuo Chadani, Suntou-gun (JP); Keisuke Nomura, Narita (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/376,199

(22) PCT Filed: Apr. 26, 2013

(86) PCT No.: PCT/JP2013/062877
§ 371 (c)(1),
(2) Date: Aug. 1, 2014

(87) PCT Pub. No.: WO2013/162073
PCT Pub. Date: Oct. 31, 2013

(65) Prior Publication Data

US 2014/0376953 A1 Dec. 25, 2014

(30) Foreign Application Priority Data

Apr. 26, 2012 (JP) ..... 2012-101851

(51) Int. Cl.
*G03G 21/18* (2006.01)
*G03G 21/00* (2006.01)

(52) U.S. Cl.
CPC ..... *G03G 21/0029* (2013.01); *G03G 21/1814* (2013.01); *G03G 2221/1618* (2013.01); *G03G 2221/183* (2013.01)

(58) Field of Classification Search
CPC ..... G03G 21/0011; G03G 21/0029; G03G 2221/1618; G03G 2221/1648
See application file for complete search history.

(56) References Cited

U.S. PATENT DOCUMENTS 5,809,374 A 9/1998 Tsuda et al.
5,867,751 A 2/1999 Nomura et al.
(Continued)

FOREIGN PATENT DOCUMENTS

CN 1098519 A 2/1995
CN 102402160 A 4/2012
(Continued)

OTHER PUBLICATIONS

International Search Report dated Aug. 29, 2013 in International Application No. PCT/JP2013/053162.
(Continued)

*Primary Examiner* — Erika J Villaluna
(74) *Attorney, Agent, or Firm* — Fitzpatrick, Cella, Harper & Scinto

(57) ABSTRACT

A cleaning device for a printer includes a cleaning member including a blade and a supporter having first and second surfaces, and a bent portion connecting them, the blade extending in a longitudinal direction at an end of the first surface opposite from the bent portion; and a resin sealing member provided between the cleaning member and the frame, the sealing member including a first portion between the cleaning member and the frame in a region from the blade to the second surface by way of the first surface along the crossing direction at each of one and the other longitudinal ends of the cleaning member, and a second portion sealing between the second surface and the frame in a region between the first portions at the one and the other ends along the longitudinal direction. The second portion is contacted to the second surface with an inclination.

24 Claims, 16 Drawing Sheets

(56) References Cited

U.S. PATENT DOCUMENTS

| | | | |
|---|---|---|---|
| 6,266,502 | B1 | 7/2001 | Matsuzaki et al. |
| 8,886,109 | B2 | 11/2014 | Chadani et al. |
| 2007/0248378 | A1 | 10/2007 | Murakami et al. |
| 2009/0154950 | A1 | 6/2009 | Kant et al. |
| 2010/0028045 | A1 | 2/2010 | Kawakami et al. |
| 2014/0086618 | A1 | 3/2014 | Shimizu et al. |

FOREIGN PATENT DOCUMENTS

| | | | | |
|---|---|---|---|---|
| EP | 0622696 | A2 | | 11/1994 |
| JP | 63098687 | A | * | 4/1988 |
| JP | 06-317961 | | | 11/1994 |
| JP | H08-211740 | A | | 8/1996 |
| JP | 2002-240156 | A | | 8/2002 |
| JP | 2004-037638 | A | | 2/2004 |
| JP | 2007-286486 | A | | 11/2007 |
| JP | 2009-265409 | A | | 11/2009 |

OTHER PUBLICATIONS

Search Report dated Jan. 4, 2016, in Chinese Patent Application No. 201380021009.4.

Office Action in Japanese Patent Application No. 2012-101851, dated Mar. 8, 2016.

* cited by examiner

A-A (a)

B-B (b)

CLEANING DEVICE, PROCESS CARTRIDGE, AND ELECTROPHOTOGRAPHIC IMAGE FORMING APPARATUS

TECHNICAL FIELD

The present invention relates to a cleaning device and a process cartridge, which are employed by an electrophotographic image forming apparatus. It relates also to an electrophotographic image forming apparatus.

Here, an "electrophotographic image forming apparatus" means an apparatus which forms an image on recording medium, with the use of an electrophotographic image formation method (electrophotographic image formation process).

Included in the examples of an electrophotographic image forming apparatus are a printer (for example, laser beam printer, LED printer, etc.), a copying machine, a facsimile machine, a word processor, and a multifunction machine (multifunction printer) capable of performing two or more functions of the preceding machines.

BACKGROUND ART

An electrophotographic image forming apparatus (which hereafter may be referred to simply as "image forming apparatus") forms an image through the following steps: First, an electrophotographic photosensitive member, as an image bearing member, which is generally in the form of a drum (photosensitive drum) is uniformly charged. Then, an electrostatic latent image (electrostatic image) is formed on the photosensitive drum by the selective exposure of the various points of the uniformly charged portion of the peripheral surface of the photosensitive drum. Then, the electrostatic latent image on the photosensitive drum is developed into a visible image (toner image) with the toner in the developer. Then, the toner image on the photosensitive drum is transferred onto recording medium such as a sheet of recording paper, a sheet of plastic, etc. Then, the toner image on the recording medium is fixed to the recording medium by the application of heat and pressure to the toner image.

The residual toner, that is, the toner remaining on the peripheral surface of the photosensitive drum after the transfer process, is removed from the photosensitive drum by a cleaning device, as a cleaning means, which is equipped with a cleaning member.

An image forming apparatus such as the one described above requires to be replenished with toner. It requires also the maintenance of its various processing means. In order to make it easier to replenish the image forming apparatus with toner, and also to maintain the processing means of the image forming apparatus, a process cartridge system, which integrally places a photosensitive drum, a charging means, a developing means, a cleaning means, etc., in a cartridge which is removably installable in the main assembly of an image forming apparatus, has been put into practical usage. A process cartridge system enables an ordinary user to maintain an electrophotographic image forming apparatus by himself or herself. Thus, it can drastically improve an electrophotographic image forming apparatus in operability. That is, a process cartridge system makes it possible to provide an image forming apparatus which is excellent in usability.

For example, a cleaning device, with which a process cartridge such as the one described above, is provided with seals for keeping sealed the gaps which are present between the cleaning member and the cleaning device frame which supports the cleaning member.

Japanese Laid-open Patent Application H08-211740 discloses a method that can prevent toner from leaking from a process cartridge, by injecting a liquid, which solidifies into elastomer, into the gaps in the joint portions of the sub-frames of a process cartridge, and the gaps between the cleaning member and the frames of the process cartridge. According to this application, the gaps which are present at the lengthwise ends of the cleaning member can be kept sealed with elastomer.

Japanese Laid-open Patent Application 2004-37638 discloses a structural arrangement for preventing toner from leaking out of a process cartridge, by the placement of seals formed of foamed elastic substance, in the gaps between the cleaning blade and the cleaning blade supporting frame, at the lengthwise ends of the cleaning member. According to this application, toner is prevented from leaking out of a process cartridge, by the placement of a member formed of foamed elastic substance, in the gaps which are present between the cleaning member and cleaning device frame, at their lengthwise ends. That is, this structural arrangement can keep sealed the gaps which extend between the cleaning member and cleaning device frame, in the widthwise direction of the cleaning member, with a sealing member formed of foamed elastic substance.

However, separately carrying out the process for coating various portions of a process cartridge with liquid elastomer, and the process for pasting the seal formed of foamed elastic substance to the various portions of a process cartridge, to keep sealed the aforementioned gaps which extend in the lengthwise or widthwise direction of the cleaning member, adds to the number of steps for manufacturing a process cartridge, which in turn leads to an increase in the cost of manufacturing a process cartridge.

Further, forming a seal by injecting (pouring) liquid elastomer into the aforementioned gaps makes it possible that minute gaps will occur between the cleaning member and seal, because of the nonuniformity in shape and measurement among the process cartridge components such as the cleaning member.

SUMMARY OF INVENTION

Thus, the primary object of the present invention is to provide a cleaning device, a process cartridge, an electrophotographic image forming apparatus which can keep sealed the gaps which are present between the cleaning member of the cleaning device, and the cleaning device frame which supports the cleaning member, and extends in the lengthwise or widthwise direction of the cleaning member, regardless of nonuniformity in shape and measurement of the components of the cleaning device.

According to an aspect of the present invention, there is provided a cleaning device for use with an image forming apparatus, said cleaning device comprising a frame; a cleaning member, mounted to said frame, for removing a developer from a surface of an image bearing member, said cleaning member including a blade member contactable to the surface of the image bearing member and a supporting member supporting said blade member, said supporting member including a first flat surface, a second flat surface extending in a direction crossing with said first surface, and a bent portion connecting said first surface and said second surface over an entire longitudinal area of said supporting member, said blade member extending along the longitudinal direction at an end portion of the first surface opposite from said bent portion with respect to a direction crossing with the longitudinal direction; and a sealing member of sealing resin material provided between said cleaning member and said frame, said sealing member including a first seal portion sealing between said cleaning member and said frame in a region from said blade member to said second surface by way of said first surface along the crossing direction at each of one and the other longitudinal end portions of said cleaning member, and a second seal portion sealing between said second surface and said frame in a region between the first seal portion at the one end portion and first seal portion at the other end portion along the longitudinal direction, wherein said second seal portion is contacted to said second surface with an inclination in a section perpendicular to the longitudinal direction.

According to another aspect of the present invention, there is provided a process cartridge detachably mountable to a main assembly of an image forming apparatus, comprising an image bearing member; a frame; a cleaning member, mounted to said frame, for removing a developer from a surface of an image bearing member, said cleaning member including a blade member contactable to the surface of the image bearing member and a supporting member supporting said blade member, said supporting member including a first flat surface, a second flat surface extending in a direction crossing with said first surface, and a bent portion connecting said first surface and said second surface over an entire longitudinal area of said supporting member, said blade member extending along the longitudinal direction at an end portion of the first surface opposite from said bent portion with respect to a direction crossing with the longitudinal direction; and a sealing member of sealing resin material provided between said cleaning member and said frame, said sealing member including a first seal portion sealing between said cleaning member and said frame in a region from said blade member to said second surface by way of said first surface along the crossing direction at each of one and the other longitudinal end portions of said cleaning member, and a second seal portion sealing between said second surface and said frame in a region between the first seal portion at the one end portion and first seal portion at the other end portion along the longitudinal direction, wherein said second seal portion is contacted to said second surface with an inclination in a section perpendicular to the longitudinal direction.

According to a further aspect of the present invention, there is provided an image forming apparatus for forming an image on a recording material, said image forming apparatus comprising (i) an image bearing member; (ii) a cleaning device including a frame, a cleaning member, mounted to said frame, for removing a developer from a surface of said image bearing member, said cleaning member including a blade member contactable to the surface of the image bearing member and a supporting member supporting said blade member, said supporting member including a first flat surface, a second flat surface extending in a direction crossing with said first surface, and a bent portion connecting said first surface and said second surface over an entire longitudinal area of said supporting member, said blade member extending along the longitudinal direction at an end portion of the first surface opposite from said bent portion with respect to a direction crossing with the longitudinal direction, a sealing member of sealing resin material provided between said cleaning member and said frame, said sealing member including a first seal portion sealing between said cleaning member and said frame in a region from said blade member to said second surface by way of said first surface along the crossing direction at each of one and the other longitudinal end portions of said cleaning member, and a second seal portion sealing between said second surface and said frame in a region between the first seal portion at the one end portion and first seal portion at the other end portion along the longitudinal direction, wherein said second seal portion is contacted to said second surface with an inclination in a section perpendicular to the longitudinal direction; and (iii) feeding means for feeding the recording material.

These and other objects, features, and advantages of the present invention will become more apparent upon consideration of the following description of the preferred embodiments of the present invention, taken in conjunction with the accompanying drawings.

DESCRIPTION OF EMBODIMENTS

Hereinafter, the cleaning device, process cartridge, and electrophotographic image forming apparatus in the embodiments of the present invention are described in detail with reference to the appended drawings.

Embodiment 1

1. General Structure of Image Forming Apparatus

Figure 1:
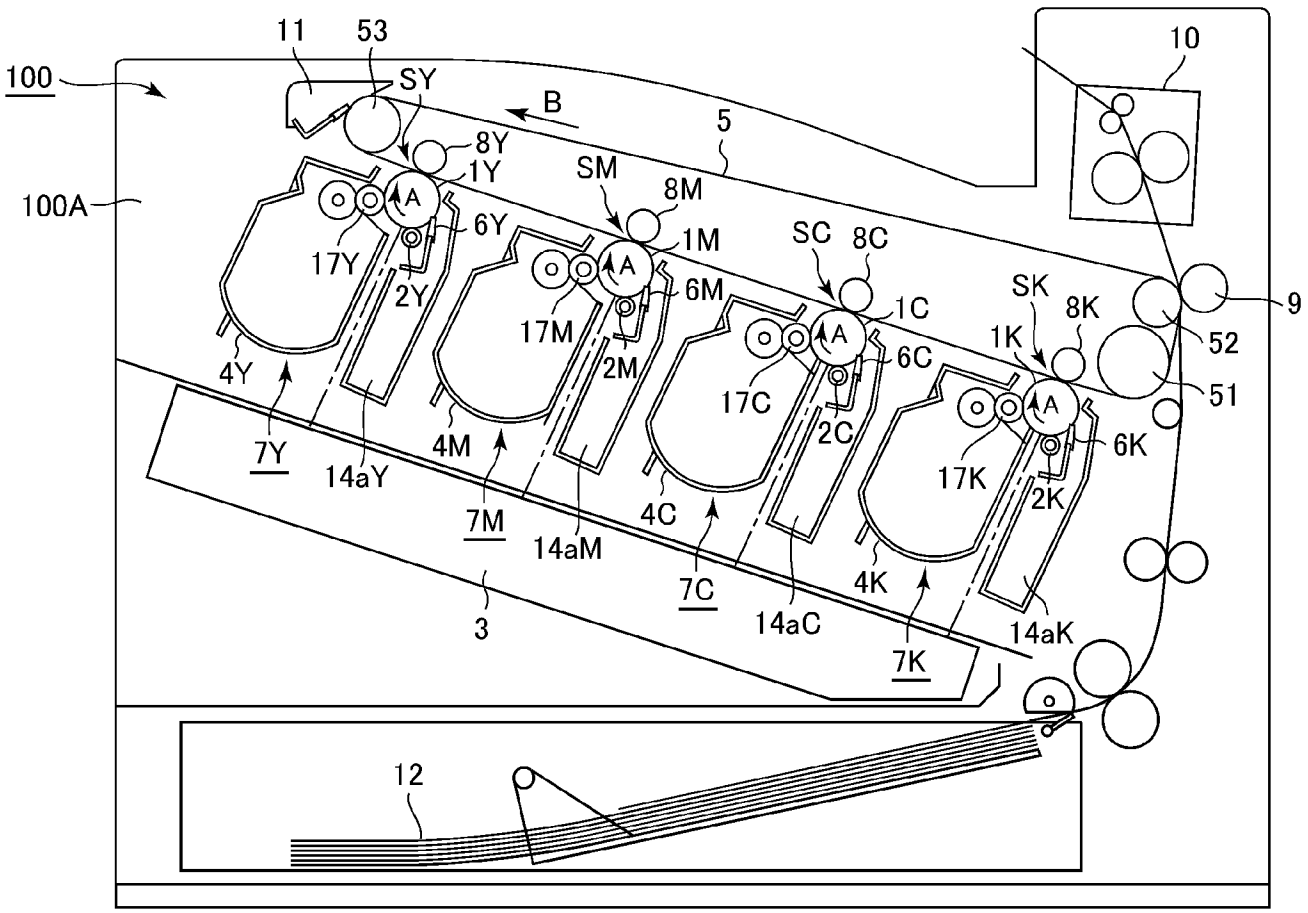
FIG. 1 is a schematic sectional view of the electrophotographic image forming apparatus in the first embodiment of the present invention.

First, the general structure of the electrophotographic image forming apparatus 100 (which hereafter will be referred to simply as image forming apparatus 100) in this embodiment of the present invention is described. FIG. 1 is a schematic sectional view of the image forming apparatus 100 in this embodiment.

The image forming apparatus 100 has the first, second, third, and fourth image formation stations SY, SM, SC, and SK for forming yellow (Y), magenta (M), cyan (C) and black (K) images, respectively, which are aligned in tandem in the direction which is intersectional to the vertical direction.

In this embodiment, the first to fourth image formation stations are practically the same in structure and operation, although they are different in the color in which they form an image. Therefore, unless they need to be differentiated, they will be described together without the suffixes Y, M, C and K which indicate the color in which they form an image.

The image forming apparatus 100 has multiple image bearing members, more specifically, four photosensitive drums 1, which are aligned in tandem, in the direction intersectional to the vertical direction. The photosensitive drum 1 rotates in the direction indicated by an arrow mark A in FIG. 1. Each image formation station is provided with a charge roller 2 and a scanner unit 3 (exposing device) which are in the adjacencies of the peripheral surface of the photosensitive drum 1. The charge roller 2 is the charging means for uniformly charging the peripheral surface of the photosensitive drum 1. The scanner unit 3 (exposing device) is the exposing means for forming an electrostatic image on the photosensitive drum 1, by scanning (exposing) the peripheral surface of the photosensitive drum 1 with the beam of laser light it emits while modulating the beam with the information of the image to be formed.

Each image formation station is also provided with a developing device 4 (which hereafter may be referred to as development unit) and a cleaning member 6, which are positioned in the adjacencies of the peripheral surface of the photosensitive drum 1. The development unit 4 is the developing means for developing an electrostatic image into a toner image. The cleaning member 6 is the cleaning means for removing the toner (transfer residual toner) which is remaining on the peripheral surface of the photosensitive drum 1 after the transfer of the toner image from the photosensitive drum 1.

Further, the image forming apparatus 100 is provided with an intermediary transfer belt 5, as an intermediary transfer member, which is for transferring the toner image on the photosensitive drum 1 onto a sheet 12 of recording medium. The intermediary transfer belt 5 is positioned so that it faces the four photosensitive drums 1.

In this embodiment, the development unit 4 uses nonmagnetic single-component developer as toner. It has a development roller 17, as a developer bearing member, which is placed in contact with the photosensitive drum 1 to develop the electrostatic image on the photosensitive drum 1.

Also in this embodiment, the photosensitive drum 1, and the processing means, more specifically, the charge roller 2, development unit 4, and cleaning member 6, which are for processing the photosensitive drum 1, make up a process cartridge 7 by being integrally placed in a cartridge. Generally speaking, a process cartridge is a cartridge in which an electrophotographic photosensitive member, and at least one among a charging means, a developing means, and a cleaning means, which are means for processing the electrophotographic photosensitive member, are integrally placed, and which is removably installable in the main assembly of an electrophotographic image forming apparatus. The process cartridge to which the present invention is related has at least a cleaning device which is in accordance with the present invention.

The process cartridge 7 is removably installable in the image forming apparatus 100 with the use of the unshown process cartridge installing means, such as cartridge installation guides and cartridge positioning members, with which the main assembly of the image forming apparatus 100 is provided.

In this embodiment, the four process cartridges 7, which are different in the color of the toner (developer) they use, but, are the same in shape. They store yellow (Y), magenta (M), cyan (C) and black (B) toner, one for one.

The intermediary transfer belt 5 is in contact with all the photosensitive drums 1, and rotates in the direction indicated by an arrow mark B in the drawings. It is suspended, and kept stretched, by multiple belt supporting members (driver roller 51, roller 52 which opposes secondary transfer roller, and idler roller 53). There are four primary transfer rollers 8, as primary transferring means, which are positioned in parallel, on the inward side of the loop which the intermediary transfer belt 5 forms, being in contact with the inward surface of the intermediary transfer belt 5 in such a manner that they oppose the photosensitive drums 1, one for one. Further, there is a secondary transfer roller 9, as the secondary transferring means, which is positioned on the outward side of the belt loop, in such a manner that it opposes the roller 52.

The image forming operation of the image forming apparatus 100 is as follows: First, the peripheral surface of the photosensitive drum 1 is uniformly charged by the charge roller 2. Then, the charged portion of the peripheral surface of the photosensitive drum 1 is scanned by (exposed to) the beam of laser light emitted by the scanner unit 3 while being modulated with the information of the image to be formed. Consequently, an electrostatic image, which reflects the information of the image to be formed, is effected on the peripheral surface of the photosensitive drum 1. Then, the electrostatic image on the photosensitive drum 1 is developed by the development unit 4 into a toner image.

The toner image formed on the photosensitive drum 1 is transferred (primary transfer) by the function of the primary transfer roller 8, onto the intermediary transfer belt 5. In an image forming operation for forming a full-color image, for example, the above-described processes are sequentially performed in each of the first to fourth image formation stations SY, SM, SC and SK. Then, the thus formed toner images, different in color, are sequentially transferred in layers onto the intermediary transfer belt 5.

Meanwhile, the sheet 12 of recording medium is conveyed in synchronism with the movement of the intermediary transfer belt 5, to the secondary transfer station, in which the four toner images, different in color, on the intermediary transfer belt 5 are transferred together (secondary transfer) onto the sheet 12 of recording medium, by the function of the secondary transfer roller 9, which is in contact with the intermediary transfer belt 5, with the presence of the sheet 12 of recording medium between itself and the intermediary transfer belt 5.

After the transfer of the toner images onto the sheet 12 of recording medium, the sheet 12 is conveyed to the fixing device 10 as a fixing means. In the fixing device 10, the toner images are fixed to the sheet 12 by the application of heat and pressure to the sheet P and the toner images thereon. Then, the sheet 12 which bears the fixed toner images is outputted as a finished print from the main assembly 100A of the image forming apparatus 100.

The primary transfer residual toner, that is, the toner remaining on the peripheral surface of the photosensitive drum 1 after the primary transfer process, is removed by the cleaning member 6, and is recovered into the chamber 14*a* for the removed toner.

As for the secondary transfer residual toner, that is, the toner remaining on the intermediary transfer belt after the secondary transfer process, it is removed by the cleaning device 11 for cleaning the intermediary transfer belt 5.

The image forming apparatus 100 is enabled to form a monochromatic image or a multicolor image, with the use of a specific one, or two or more (which do not need to be all), respectively, of the image formation stations.

2. Process Cartridge

Figure 2:
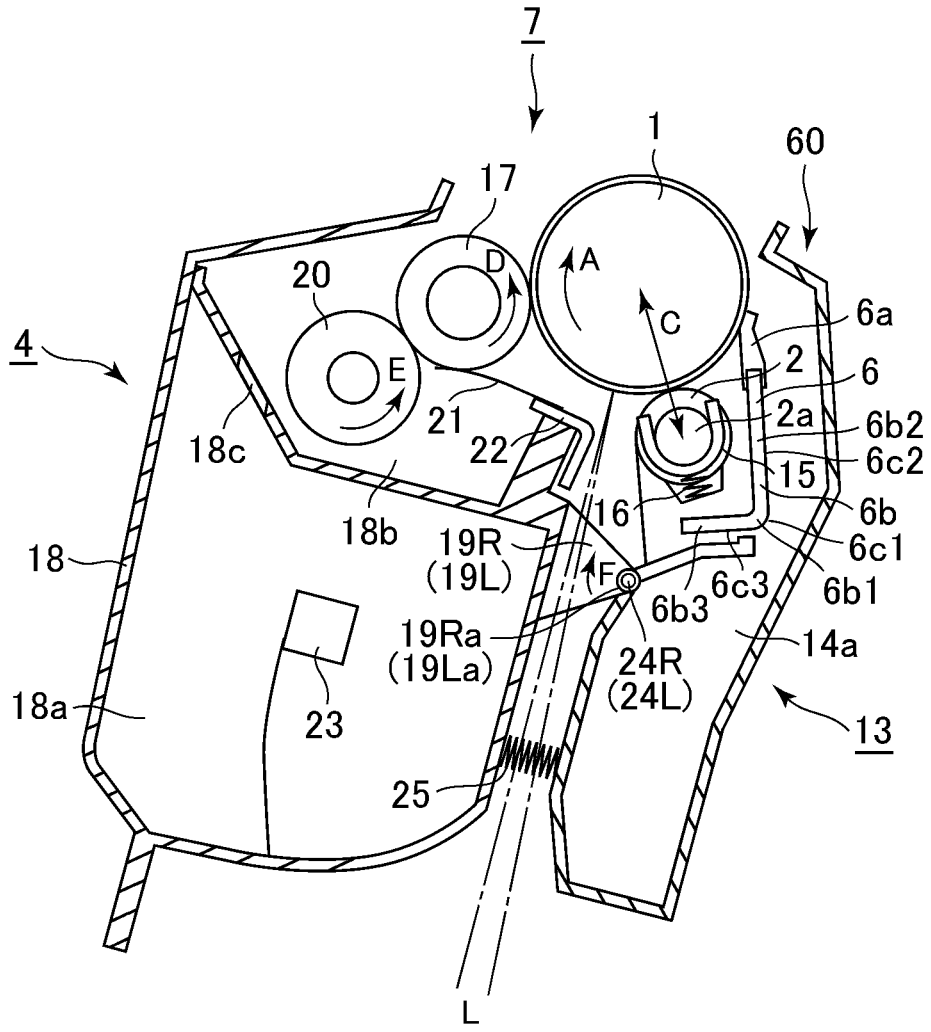
FIG. 2 is a schematic sectional view of the process cartridge in the first embodiment of the present invention.

Next, the general structure of the process cartridge 7 to be installed in the image forming apparatus 100 in this embodiment is described. FIG. 2 is a schematic sectional view of the process cartridge 7 when its photosensitive drum 1 and development roller 17 are in contact with each other.

The process cartridge 7 has: a photosensitive member unit 13 equipped with the photosensitive drum 1, etc.; and the development unit 4 equipped with the development roller 17, etc.

The photosensitive member unit 13 has a cleaning device frame 14 as the frame which supports various components of the photosensitive member unit 13. To the cleaning device frame 14, the photosensitive drum 1 is rotatably attached, with the placement of a pair of unshown bearings between the photosensitive drum 1 and the frame 14, in such a manner that the photosensitive drum 1 can be rotated in the direction indicated by the arrow mark A in the drawings. The beam L of laser light emitted from the scanner unit 3 with which the image forming apparatus main assembly 100A is provided, is projected upon the peripheral surface of the photosensitive drum 1 of the photosensitive member unit 13. Further, the photosensitive member unit 13 is provided with the charge roller 2 and cleaning member 6, which are positioned in the adjacencies of the peripheral surface of the photosensitive drum 1.

The cleaning member 6 is made up of an elastic portion 6*a* for removing the toner remaining on the peripheral surface of the photosensitive drum 1, and a supporting portion 6*b* for supporting the elastic portion 6*a*. The elastic portion 6*a* is solidly attached to the supporting portion 6*b*. The elastic portion 6*a* is formed of elastic substance such as rubber, and is in the form of a blade (rubber blade). In this embodiment, the supporting portion 6*b* is formed by cutting a flat metallic sheet with the use of a punching press. As the rubber substance as the material for the elastic portion 6*a*, urethane rubber is excellent. As for the material for the supporting portion 6*b*, a plated sheet of steel is excellent. It may be a plated sheet of stainless steel. In order to prevent the problem that when photosensitive drum 1 is attached to the cleaning device frame 14, the support portion 6*b* bends in the direction perpendicular to the lengthwise direction of the cleaning device frame 14, the support portion 6*b* is bent along its entire length, being thereby provided with a bend portion 6*b*1, which extends from one lengthwise end to the other of the support portion 6*b*. The cleaning device 11 is structured so that as the transfer residual toner is removed from the peripheral surface of the photosensitive drum 1, it falls into the waste toner storage 14*a* of the cleaning device frame 14.

The cleaning device 60 is made up of a minimum of the cleaning member 6 for removing the toner from the image bearing member, cleaning device frame 14 for supporting the cleaning member 6, seals 28 (which will be described later) for keeping the unwanted gaps between the cleaning member 6 and frame 14.

To describe further, the supporting portion 6*b* is a long and narrow piece of metallic plate bent in curvature at a preset portion 6*b*1 (bend) across the entire lengthwise range. Thus, its cross section at a plane perpendicular to its lengthwise direction (which hereafter may be referred to as first direction) is roughly L-shaped. In this embodiment, the bend portion 6*b*1 of the support portion 6*b* of the cleaning member 6 is arced in cross section, across its center portion in terms of its widthwise direction. That is, the support portion 6*b* is made up of the first and second flat sections 6*b*2 and 6*b*3, which are connected by the bend portion 6*b*1 and are perpendicular to each other. With regard to the components of the cleaning member 6 and those related thereto, the direction (first direction) parallel to the bend portion 6*b*1 may be referred to as the lengthwise direction of the cleaning member 6, whereas the direction perpendicular to the bend portion 6*b*1 may be referred to as the widthwise direction of the cleaning member 6. In the process cartridge 7, the bend portion 6*b*1, first section 6*b*2, and second section 6*b*3 are all parallel to the rotational axis of the photosensitive drum 1. The elastic portion 6*b* of the cleaning member 6 is solidly attached to the opposite edge of the first section 6*b*2 from the bend portion 6*b*1. The elastic portion 6*a* extends from one lengthwise end of the first section 6*b*2 to the other lengthwise end. The support portion 6*b* is bent so that after the attachment of the cleaning member 6 to the cleaning device frame 14, the second section 6*b*3 protrudes toward the photosensitive drum 1 from the first section 6*b*2. Hereafter, the surface of the bend portion 6*b*1, surface of the first section 6*b*2, and surface of the second section 6*b*3, which face inward of the cleaning device frame 14, that is, those with which the seals 28 (which will be described later) are placed in contact, will be referred to as the bend portion surface 6*c*1, first surface 6*c*2, and second surface 6*c*3.

The process cartridge 7 is provided with a pair of charge roller bearings 15, which are attached to the cleaning device frame 14 in such a manner that as the charge roller 2 is borne by the charge roller bearings 15, the rotational axis of the charge roller 2 becomes parallel to the rotational axis of the photosensitive drum 1, and also, that the charge roller bearings 15 are movable in the direction indicated by an arrow mark C in the drawings. More specifically, the axle 2*a* of the charge roller 2 is rotatably borne by the charge roller bearings 15. Further, the charge roller bearings 15 are kept pressed toward the photosensitive drum 1 by a pair of compression springs 16.

As for the development unit 4, it has a developing unit frame 18 which supports various internal components of the development unit 4. It is also provided with the development roller 17, as a developer bearing member, which rotates in contact with the photosensitive drum 1, in the direction (counterclockwise direction) indicated by an arrow mark D in the drawings. The development roller 17 is rotatably supported by its lengthwise ends (one lengthwise end and other end in terms of direction parallel to its rotational axis), by the developing unit frame 18, with the placement of a pair of development roller bearings 19 (19R and 19L) between the development roller 17 and developing unit frame 18. The development roller bearings 19 (19R ad 19L) are attached to the lengthwise ends of the development unit frame 18, one for one.

Further, the development unit 4 is provided with a developer storage chamber 18*a* (which hereafter will be referred to as toner storage chamber), and a development chamber 18*b* in which the development roller 17 is positioned. The development unit 4 is also provided with a toner supply roller 20, as a developer supplying member, which rotates in contact with the development roller 17, in the direction indicated by an arrow mark E in the drawings, and a development blade 21, as a developer regulating member, which is for regulating the toner layer formed on the peripheral surface of the development roller 17. The developer supply roller 20 and development blade 21 are positioned in the development chamber 18*b*. The development blade 21 is solidly attached to a development blade holder 22, by being welded to the development blade holder 22 with the use of YAG laser, for example. Further, the development unit 4 is provided with a stirring member 23 which is positioned in the toner storage chamber 18*a* of the development unit 4 to convey the toner in the storage chamber 18*a* to the toner supply roller 20 while stirring the toner. The stirring member 23 delivers toner from the toner storage chamber 18*a* to the development chamber 18*b* through an opening 18*c*.

Further, the development unit 4 is attached to the photosensitive member unit 13 in such a manner that it is pivotally movable relative to the photosensitive member unit 13, about a pair of shafts 24 (24R and 24L) fitted in a pair of holes 19Ra and 19La, with which the right and left development roller bearings 19R and 19L, respectively, are provided. The development unit 4 is under the pressure from the compression springs 25. Therefore, as the process cartridge 7 begins to be used for an image forming operation, the development unit 4 is pivotally moved about the shafts 24 in the direction indicated by an arrow mark F in the drawings. Therefore, the development roller 17 comes into contact with the photosensitive drum 1.

3. Structural of Seal for Keeping Waste Toner Storage Sealed

Next, the structure of the seal for keeping the waste toner storage sealed in this embodiment is described.

Figure 3:
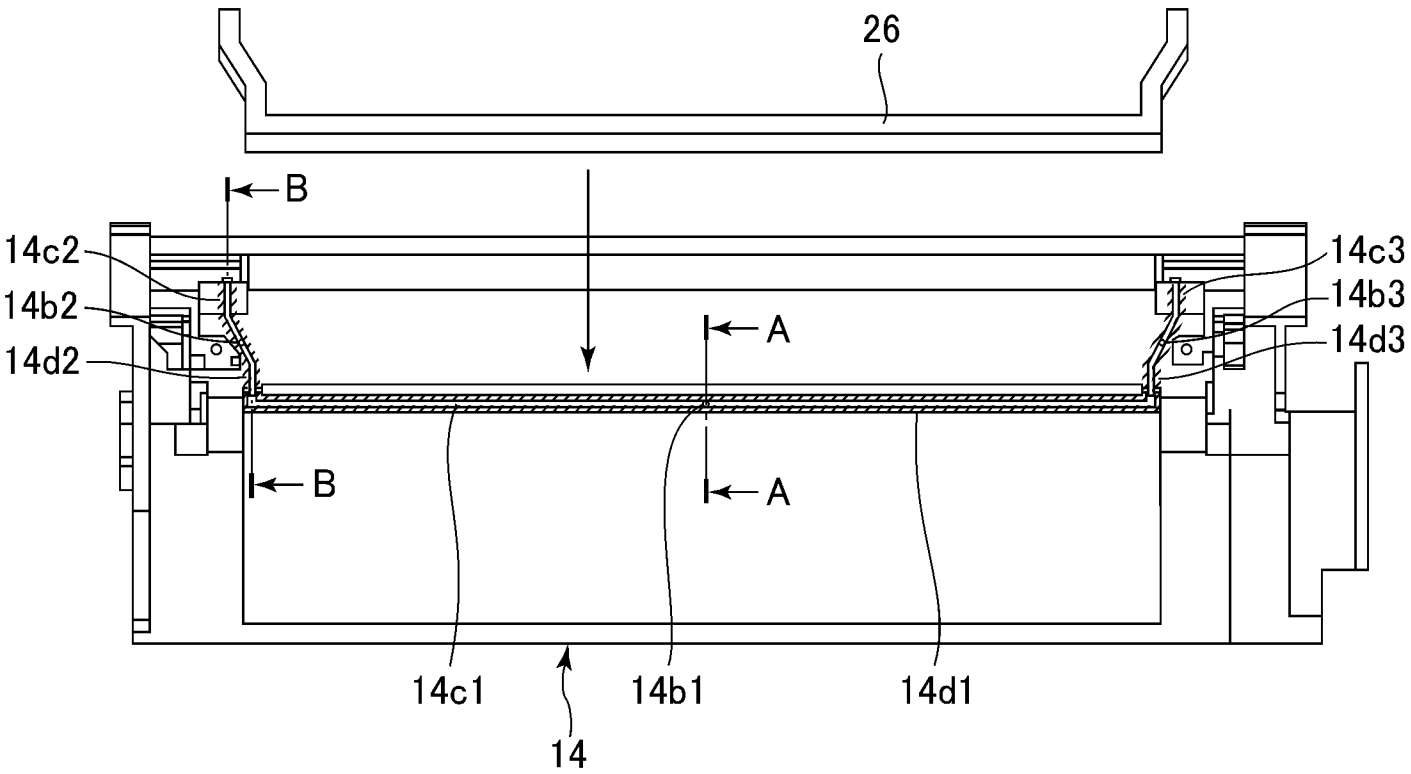
FIG. 3 is a schematic front view of the cleaning device frame in the first embodiment of the present invention.
Figure 4:
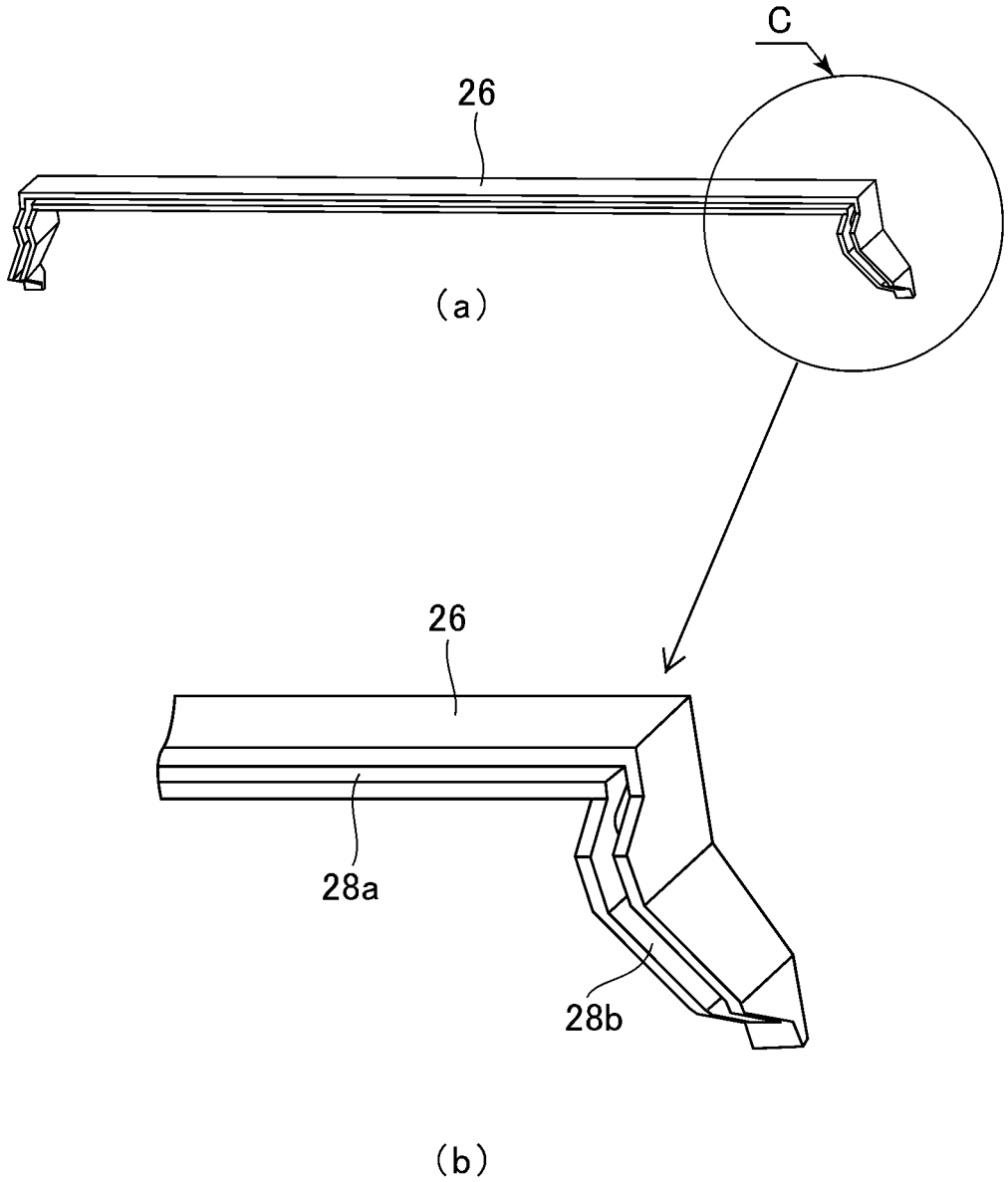
FIG. 4 is a combination of a perspective view of the metallic mold for the cleaning device seal and an enlarged perspective view of one of the lengthwise ends of the metallic mold, in the first embodiment of the present invention.

FIG. 3 is a schematic front view of the cleaning device frame 14 in this embodiment, prior to the formation, by injection molding, of the cleaning device sealing member 28 (which hereafter may be referred to simply as seal 28) as a component for keeping sealed the unwanted gap between the cleaning member 6 and cleaning device frame 14. The cleaning device frame 14 is provided with injection holes 14*b*1-14*b*3 through which liquid elastomer as the material for the seal 28 is injected, and grooves 14*c*1-14*c*3 into which the liquid elastomer is injected. The method for molding the seal 28 is as follows: First, a metallic mold 26 shaped to yield the seal 28 is placed in contact with the surfaces 14*d*1-14*d*3 indicated by hatching in FIG. 3, and clamped to the cleaning device frame 14. FIG. 4(*a*) is a perspective view of the portion of the back side of the metallic mold 26 (shown in FIG. 3) for the seal 28, which is made in the shape of the seal 18. FIG. 4(*b*) is an enlarged perspective view of the section C of FIG. 4(*a*).

Figure 5:
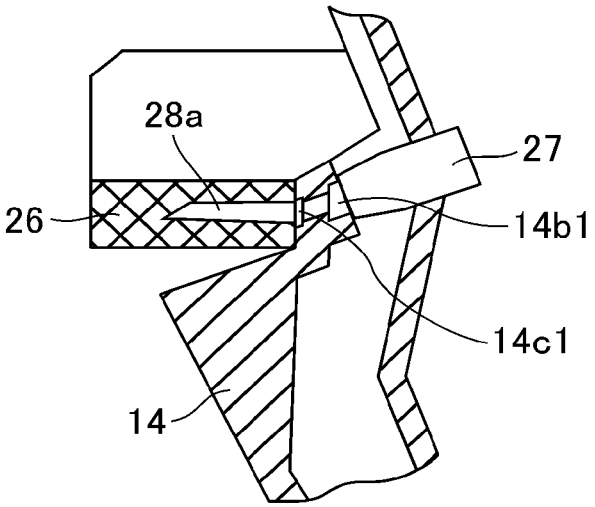
FIGS. 5(*a*) and 5(*b*) are schematic sectional views of a part of the cleaning device frame, the cleaning device seal, and the metallic mold for the cleaning device seal, at planes A-A and B-B, respectively, in FIG. 3, after the clamping of the mold to the cleaning device frame.
Figure 5:
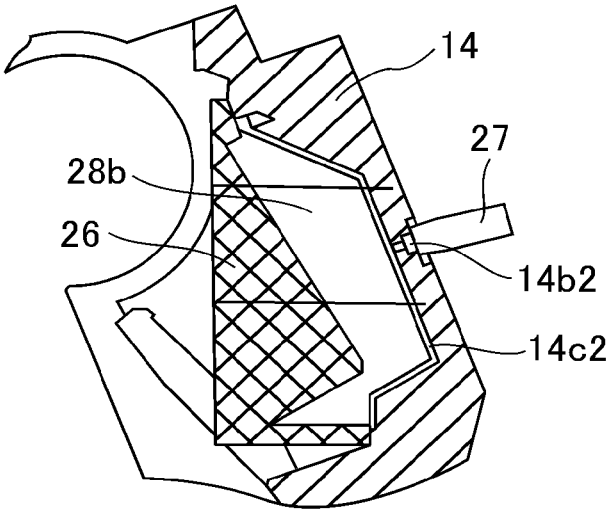

FIG. 5(*a*) is a schematic sectional view of the cleaning device frame 14, at a plane (plane A-A in FIG. 3) which coincides with the injection hole 14*b*1, after the clamping of the metallic mold 26 for the seal 28 to the cleaning device frame 14. FIG. 5(*b*) is a schematic sectional view of the cleaning device frame 14, at a plane (plane B-B in FIG. 3) which coincides with the injection hole 14*b*2.

Referring to FIG. 5(*a*), as the liquid elastomer is injected into the injection hole 14*b*1 from an injecting apparatus 27 shown in FIG. 5(*a*), it flows into the space surrounded by the wall of the groove 14*c*1 of the cleaning device frame 14 and the metallic mold 26 for the seal 28, and continues to flow toward both of the lengthwise ends of the cleaning device frame 14, while sealing the gap which extends between the cleaning member 6 and cleaning device frame 14, in the lengthwise direction of the cleaning device frame 14.

Next, referring to FIG. 5(*b*), as the liquid elastomer is injected into the injection hole 14*b*2, it flows into the space surrounded by the wall of the groove 14*c*2 of the cleaning device frame 14 and the metallic mold 26 for the seal 28, and continues to flow toward both the widthwise ends of the cleaning device frame 14 while sealing the gap which extends between the cleaning member 6 and cleaning device frame 14, in the widthwise direction of the cleaning device frame 14. The movement of the liquid elastomer poured into the injection hole 14*b*3 is the same as that of the liquid elastomer poured into the injection hole 14*b*2.

The metallic mold 26 for the seal 28 are shaped so that the space formed by the portion of the mold 26, which corresponds to the second portion 28*a* of the seal 28, and the cleaning device frame 14, is in connection to the space formed by the portion of the mold 26, which corresponds to the first portion 28*b* of the mold 26 (FIG. 4).

Figure 6:
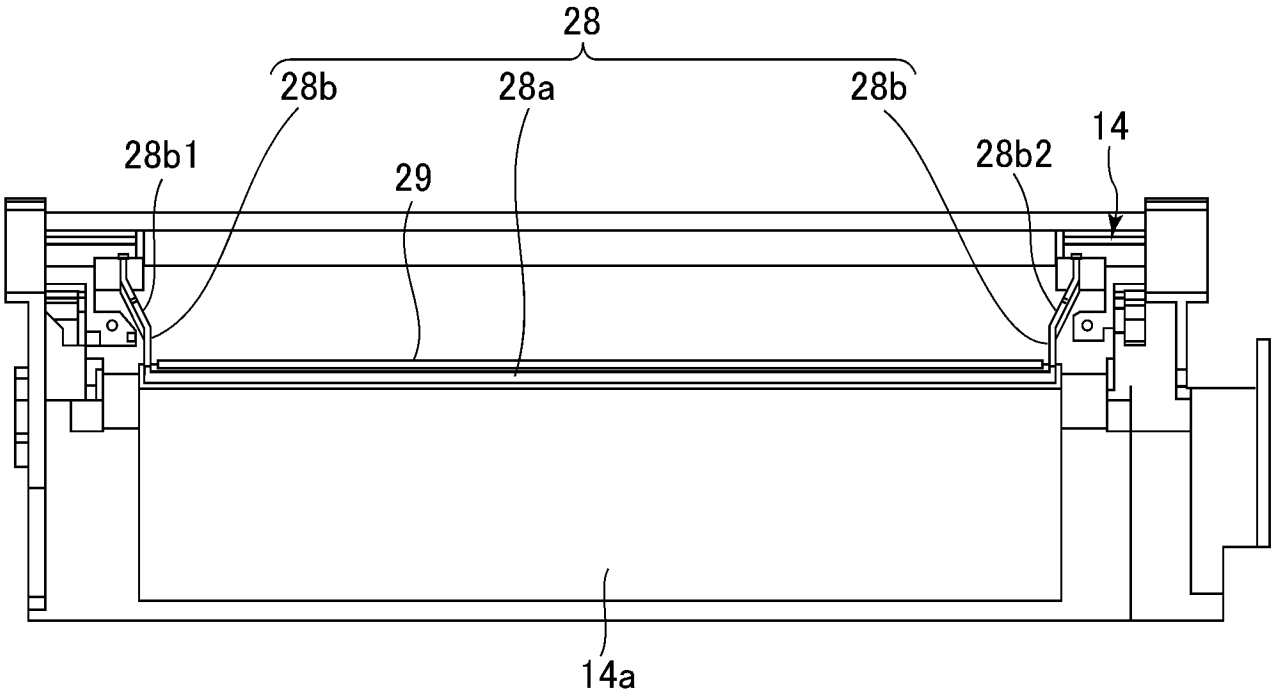
FIG. 6 is a schematic front view of the cleaning device frame after the molding of the cleaning device seal, in the first embodiment of the present invention.

FIG. 6 is a schematic front view of the cleaning device frame 14 after the molding of the seal 28. As described above, the metallic mold 26 for the seal 28 is shaped so that the first portion 28*b* of the seal 28, which is formed of the elastomer which is made to flow in the widthwise direction of the cleaning device frame 14, is in connection to the second portion 28*a* of the seal 28, which is formed of the elastomer which is made to flow in the lengthwise direction. Therefore, as the elastomer is poured into the injection holes 14*b*1, 14*b*2 and 14*b*3, the seal 28 is molded of the elastomer in such a shape that the second portion 28*a* of the seal 28, which is formed by the elastomer which flows in the lengthwise direction, is in connection to the first portions 28*b* of the seal 28 (which are at lengthwise ends, one for one), which are formed by the elastomer which flows in the widthwise direction.

In this embodiment, the first portion 28*b* of the seal 28 is the portion of the seal 28 which is for sealing the portion of the gap, which extends between the cleaning member 6 and cleaning device frame 14, in the widthwise direction of the cleaning device frame 14, from the widthwise end of the cleaning member 6, which is provided with the elastic portion 6*a*, to the other widthwise end of the cleaning member 6, which is not provided with the elastic portion 6*a*, that is, the one which has the support portion 6*b*. As for the second portion 28*a* of the seal 28, it is for sealing the gap which is on the opposite side of the cleaning member 6 from the elastic portion 6*a*, and extends between the cleaning member 6 and cleaning device frame 14, in the lengthwise direction, from one lengthwise end of the support portion 6*b* to the other.

That is, in this embodiment, the cleaning member 6 has the elastic portion 6*a*, which is placed in contact with the photosensitive drum 1, and the support portion 6*b* which supports the elastic portion 6*a*. The support portion 6*b* has: the first surface 6*c*2 which is flat; the second surface 6*c*3 which is flat and intersectional to the first surface 6*c*2; and the curved surface 6*c*1 which connects the first and second surfaces 6*c*2 and 6*c*3 across their entire range in terms of the first direction (lengthwise direction) of the support portion 6*b*. The elastic portion 6*a* is attached to the opposite edge of the curved surface 6c2 from the curved surface 6c1, in terms of the direction perpendicular to the above-described first direction, and extends along the edge in the first direction. The seal 28 has the first and second portions 28b and 28a. That is, the first portion 28b keeps sealed the gap which is between the cleaning member 6 and cleaning device frame 14 and extends in the direction perpendicular to the above described first direction, across the entire range which includes the elastic portion 6a, first surface 6c2, and second surface 6c3.

The first and second portions 28b and 28a are formed in a single piece, of the elastomer, between the cleaning member 6 and cleaning device frame 14. Elastomers which are suitable as the material for the seal 28 are styrene, such as styrene elastomer, silicone rubber, soft rubber, and the like. The elastomer used in this embodiment is styrene elastomer. The seal 28 in this embodiment is on the cleaning device frame 14, being attached to the cleaning device frame 14 as if it were an integral part of the cleaning device frame 14.

With regard to the structure of the seal 28 for keeping sealed the unwanted portion of the gap between the cleaning member 6 and cleaning device frame 14, the first and second portions 28b and 28a of the seal 28 in this embodiment are formed together as the integral parts of the seal 28. Thus, it can reduce the number of steps necessary to assemble the process cartridge 7 (cleaning device), compared to a process cartridge 7 structured so that the seal for keeping sealed the gap between the cleaning member 6 and cleaning device frame 14 at the lengthwise ends of the cleaning member 6, and the seal for keeping sealed the gap which extends between the cleaning member 6 and cleaning device frame 14, along the support portion 6b, in the lengthwise direction, are two separate seals.

Referring to FIG. 6, the first portion 28b of the seal 28, which seals the portion of the gap between the cleaning member 6 and cleaning device frame 14, which extends in the widthwise direction of the cleaning device frame 14, has the slanted surfaces 28b1 and 28b2, which diagonally extend from the lengthwise left and right ends of the cleaning device frame 14 to the lengthwise left and right ends, respectively, of the opening 29 of the waste toner storage. Because the seal 28 is provided with these slanted surfaces 28b1 and 28b2, the toner scraped away from the peripheral surface of the photosensitive drum 1 by the lengthwise end portions of the cleaning member 6 is guided into the opening 29 of the waste toner storage 14a as it falls down.

Figure 7:
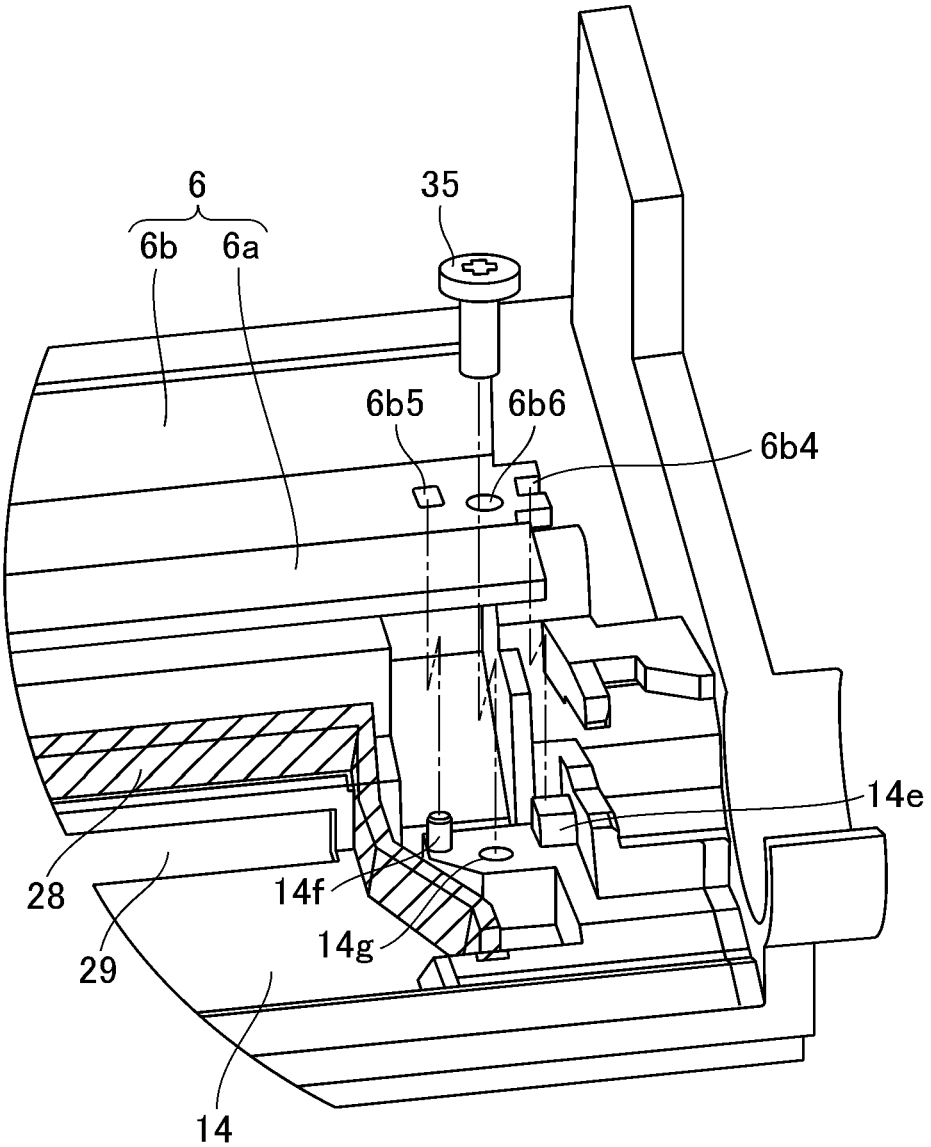
FIG. 7 is a partially exploded schematic perspective view of one of the lengthwise ends of the cleaning device, and is for showing the steps for attaching the cleaning member to the cleaning device frame, in the first embodiment of the present invention.

FIG. 7 is a partially exploded schematic perspective view of one of the lengthwise ends of the cleaning device 11, immediately before the cleaning member 6 is attached to the cleaning device frame 14 as if it is dropped into the cleaning device frame 14. Incidentally, in this detailed description of the embodiments of the present invention, the description of one of the lengthwise end portions of the cleaning member 6, and the components related thereto, applies to the other lengthwise end portions of the cleaning member 6, and the components related thereto, unless specifically noted.

Referring to FIG. 7, the cleaning member 6 is to be lowered into the cleaning device frame 14 in such a manner that a projection 14e, with which the lengthwise end portion of the cleaning device frame 14 is provided, fits into a groove 6b4 with which the lengthwise end portion of the support portion 6b of the cleaning member 6 is provided. During this lowering of the cleaning member 6, a boss 14f with which the lengthwise end of the cleaning device frame 14 is provided fits into an elongated hole 6b5 with which the corresponding lengthwise end of the support portion 6b of the cleaning member 6 is provided. Therefore, the movement of the cleaning member 6 in its widthwise direction is regulated by the projection 14e of the cleaning device frame 14, and that in the lengthwise direction is regulated by the boss 14f of the cleaning device frame 14.

Figure 8:
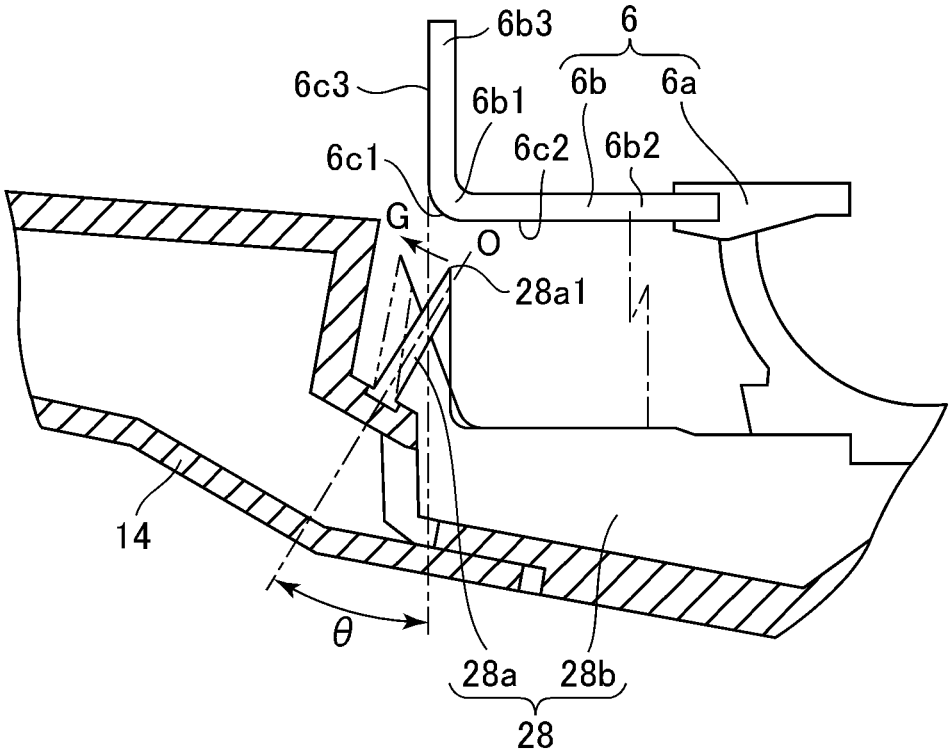
FIG. 8 is a schematic sectional view of a part of the cleaning device, cleaning device seal, and cleaning member, in the first embodiment of the present invention, and is for showing the process for attaching the cleaning member to the cleaning device frame.

FIG. 8 is a schematic sectional view of a combination of a part of the cleaning device frame 14 and the cleaning member 6 immediately before the cleaning member 6 is attached to the cleaning device frame 14 by being lowered into the cleaning device frame 14 as if it were dropped into the cleaning device frame 14 after the molding of the seal 28. Referring to FIG. 8, the seal 28 is molded so that in terms of the sectional view at a plane parallel to the widthwise direction of the cleaning device frame 14, the shape of the second portion 28a of the seal 28, which is for sealing the portion of the gap between the cleaning member 6 and cleaning device frame 14, which extends in the lengthwise direction of the cleaning member 6, is such that the line O in FIG. 8, which coincides with the center of the portion 28a of the seal 28 in terms of the thickness direction of the portion 28a, is tilted relative to the second surface 6c3 (which seal 28 contacts) of the support portion 6b of the cleaning member 6, at an angle of θ. In this embodiment, the tip portion 28a1 of the second portion 28a of the seal 28 is pointed in such a manner that the angle between its slanted surface and the aforementioned line O is roughly the same as the abovementioned angle θ, so that the slanted surface of the tip portion 28a1 becomes roughly parallel to the second surface 6c3 of the cleaning member 6. That is, the second portion 28a of the seal 28 is molded in the shape of such a lip that is angled relative to the second surface 6c3 of the support portion 6b of the cleaning member 6. More specifically, the cleaning device frame 14 and seal 28 are formed so that the angle θbecomes no less than zero and no more than 90°(0°<θ<90°).

When the cleaning member 6 is attached to the cleaning device frame 14, the tip portion 28a1 of the second portion 28a of the seal 28 which is for sealing the portion of the gap between the cleaning member 6 and cleaning device frame 14, which extends in the lengthwise direction of the cleaning member 6, is to be held away from the cleaning member 6 by being pulled in the direction indicated by an arrow mark G, in order to prevent the tip portion 28a1 from being caught by the cleaning member 6. It is to be released after the attachment of the cleaning member 6 to the cleaning device frame 14. As it is released, the second portion 28a of the seal 28 comes into contact with the second surface 6c3 of the cleaning member 6. Further, as the tip portion 28a1 is released, the first portion 28b of the seal 28, which is for sealing the portion of the gap between the cleaning member 6 and cleaning device frame 14, which extends in the widthwise direction of the cleaning member 6, also comes into contact with the cleaning member 6 (elastic portion 6a, first surface 6c2, bend portion surface 6c1, and second surface 6c3). It should be noted here that the structural arrangement for the cleaning member 6 and cleaning device frame 14 is such that as the first and second portions 28b and 28a come into contact with the cleaning member 6, the seal 28 becomes optimally compressed, being thereby made to airtightly contact the cleaning member 6 by its resiliency.

Referring to FIG. 7, each of the lengthwise end portions of the cleaning device frame 14 is provided with a hole 14g for a small screw. Thus, the cleaning member 6 is solidly attached to the cleaning device frame 14 by a small screw 35 put through the small hole 6b6, with which each of the lengthwise end portions of the cleaning member 6 is provided, and screwed into the hole 14g.

Figure 9:
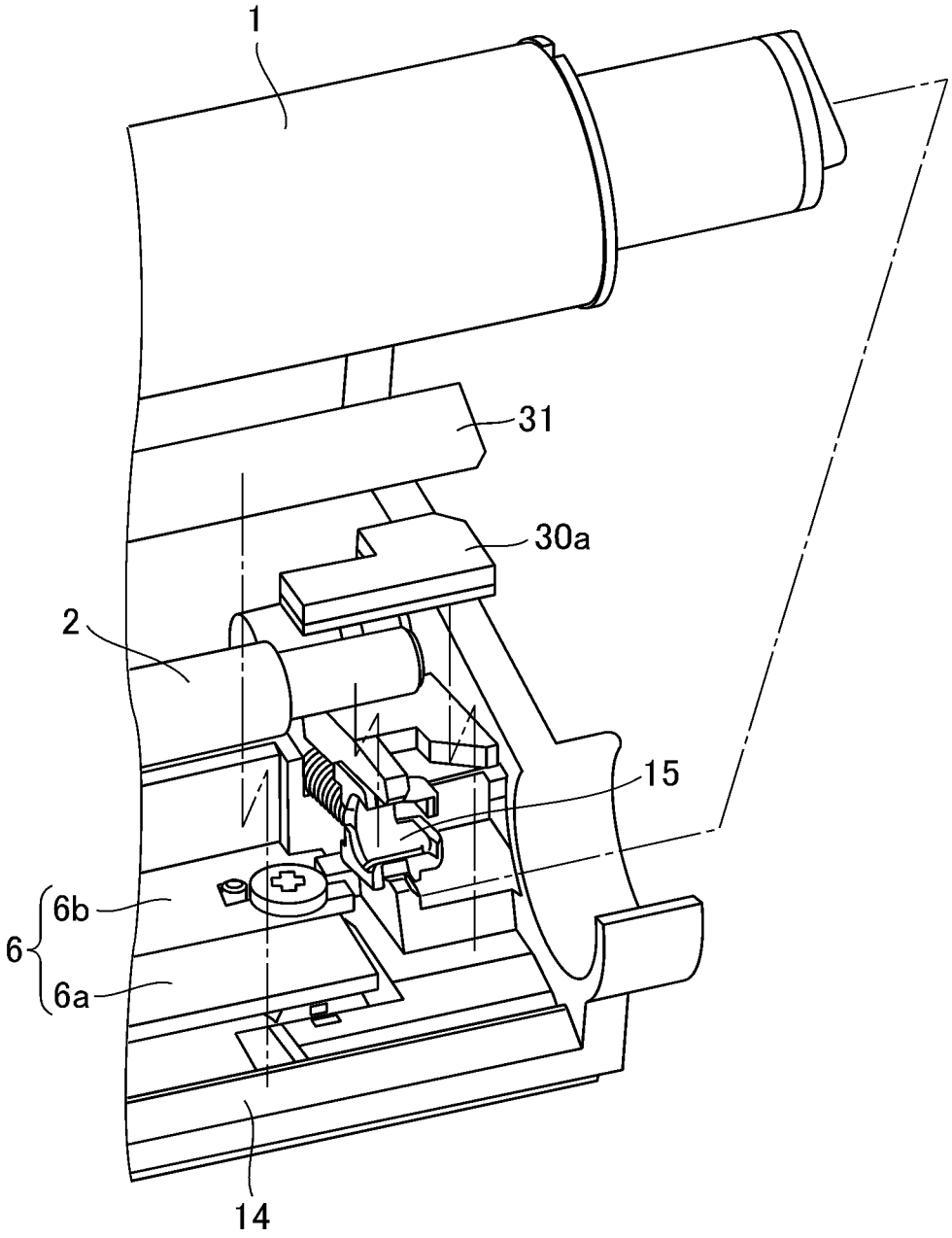
FIG. 9 is an exploded perspective view of one of the lengthwise ends of the photosensitive member unit in the first embodiment of the present invention, and is for showing the procedure for assembling the unit.

FIG. 9 is a drawing for showing the sequential steps for assembling the photosensitive member unit 13. After the attachment of the cleaning member 6 to the cleaning device frame 14, the charge roller 2 is attached to the charge roller bearings 15. Then, an end seal 30*a* for sealing the gap between the photosensitive drum 1 and cleaning device frame 14 at the corner of the elastic portion 6*a* of the cleaning member 6 is attached. The end seal 30*a* is made of woven cloth such as pile. Further, a reception sheet 31 for keeping sealed the portion of the gap between the photosensitive drum 1 and cleaning device frame 14, which extends in the lengthwise direction of the photosensitive drum 1, is attached to the cleaning device frame 14. More specifically, the reception sheet 31 is attached to the edge of the cleaning device frame 14, which faces the peripheral surface of the photosensitive drum 1, in such a manner that it remains in contact with the peripheral surface of the photosensitive drum 1. The reception sheet 31 is formed of a thin sheet of PET, PPS, or the like, by punching. The end seal 30*a* and reception sheet 31 are pasted to the unshown pieces of two-sided adhesive tape pasted to the preset surface areas of the cleaning device frame 14. Thereafter, the photosensitive drum 1 is attached to the cleaning device frame 14, with the placement of the unshown bearings between the photosensitive drum 1 and cleaning device frame 14.

Figure 10:
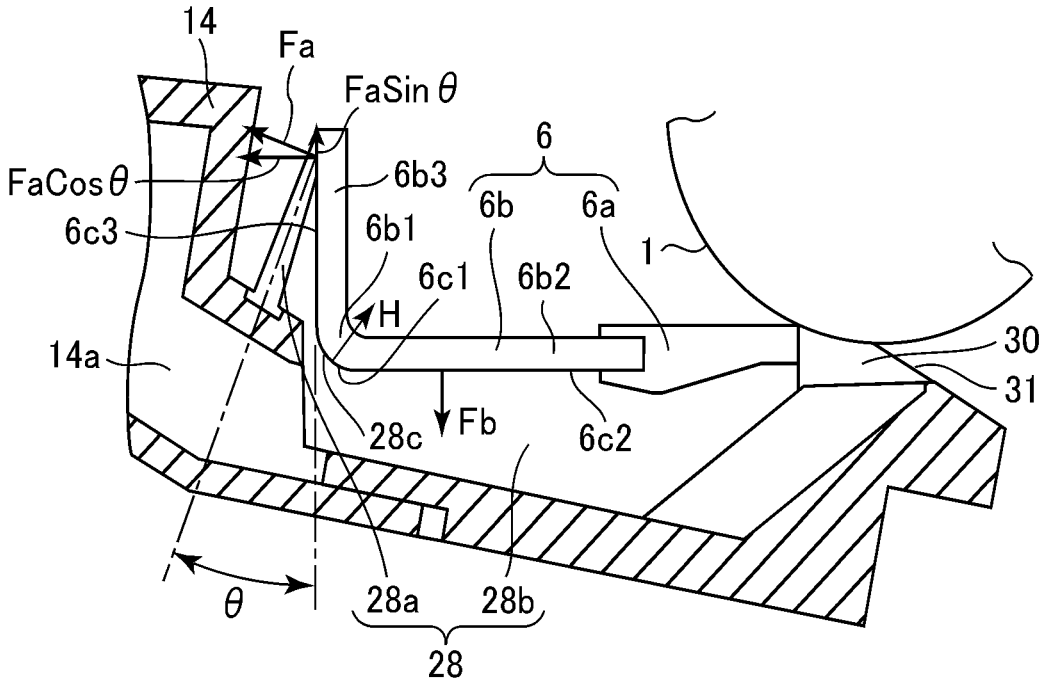
FIG. 10 is a schematic sectional view of a part of the photosensitive member unit in the first embodiment of the present invention.

FIG. 10 is a sectional view of the photosensitive member unit 13 after the attachment of the photosensitive drum 1 to the cleaning device frame 14. It does not show the charge roller 2. Referring to FIG. 10, the waste toner storage portion 14*a* is the space surrounded by the multiple components of the photosensitive member unit 13, that is, the photosensitive drum 1, cleaning member 6, reception sheet, end seal 30, seal 28, and cleaning device frame 14.

It is possible that when the gaps which extend between the cleaning member 6 and cleaning device frame 14 in the widthwise and lengthwise directions of the cleaning member 6 are sealed with elastomer, they will remain minutely unsealed at the corners of the cleaning device frame 14 and/or the bend portion of the cleaning member 6, because of the deviation, in shape and measurement, of various components from their specification. Therefore, even after the sealing of the abovementioned gaps, it is possible for the developer (toner) to leak from the process cartridge 7, in particular, from where the cleaning device frame 14 opposes the bend portions of the cleaning member 6. In this embodiment, therefore, the photosensitive member unit 13 is structured so that the aforementioned line O in FIG. 8 (sectional view of part of cleaning device frame 14, and cleaning member 6, at plane which is roughly perpendicular to abovementioned first direction (lengthwise direction)) is tilted relative to the second surface 6*c*3 of the cleaning member 6.

That is, the second portion 28*a* of the seal 28, which is for sealing the portion of the gap between the cleaning member 6 and cleaning device frame 14, which extends in the lengthwise direction of the cleaning member 6, is subjected to a reaction force F1 by the support portion 6*b* of the cleaning member 6. As described above, the second portion 28*a* of the seal 28 is tilted relative to the second surface 6*c*3 of the support portion 6*b* at the angle θ. Therefore, the actual amount of the force to which the second portion 28*a* is subjected, is a component of the reaction force Fa, that is, Fa Sin θ, which is parallel to the second surface 6*c*3 and works in the opposite direction from the bend portion 6*c*1. Further, the right side (tip portion 28*a*1), in terms of the horizontal direction, in the drawings, of the second portion 28*a* of the seal 28 is subjected to the other component of the reaction force Fa, that is, Fa Cos θ, which acts upon the second portion 28*a* in the direction perpendicular to the second surface 6*c*3.

The first portion 28*b* of the seal 28, which is for keeping sealed the portion of the gap between the cleaning member 6 and cleaning device frame 14, which extends in the widthwise direction of the cleaning device frame 14, is subjected by the support portion 6*b*, more specifically, the first surface 6*c*2, to a reactive force Fb which acts in the vertically downward direction in the drawings.

Therefore, the corner portion 28*c* of the seal 28, which is in contact with the bend portion 6*b*1 (that is, bend portion surface 6*c*1) of the support portion 6*b*, is pulled by a force Fa Sin θ in the vertically upward direction, and also, pulled by a force Fb in the vertically downward direction. As the seal 28 made of elastomer is pulled in these upward and downward forces, the corner portion 28*c* deforms in such a manner that it presses on the support portion 6*b* in the direction indicated by arrow mark H in the drawing. As the corner portion 28*c* deforms in the direction to press on the support portion 6*b*, the contact pressure between the bend portion 6*b*1 and corner portion 28*c* increases.

Therefore, it is ensured that even if the support portion 6*b* and bend portion 6*b*1 slightly differ in measurement from their specification, and/or the corner portion 28*c* of the seal 28 is slightly different in shape from its specification, the seal 28 airtightly contacts, and remains airtightly in contact with, the bend portion 6*b*1 of the support portion 6*b* of the cleaning member 6. Therefore, the waste toner is prevented from leaking from the portion of the photosensitive member unit 13, which corresponds to the bend portion 6*b*1 of the support portion 6*b* of the cleaning member 6.

The abovementioned angle θ of the second portion 28*a* of the seal 28 relative to the second surface 6*c*3 of the cleaning member 6 is desired to be no less than 0° and no more than 90° (0°<θ<90°). That is, if θ=0°, the force Fa Cos θ, which is horizontal in the drawings and presses on the support portion 6*b* is zero (θ=0). Therefore, the second portion 28*a* fails to keep sealed the waste toner in the waste toner storage portion 14*a*. Also, if 6=90°, the force Fa Sin θ, which is vertical in the drawings, is zero. Therefore, there is no force that pulls the corner portion 28*c* of the seal 28. This is why the angle θ is desired to be no less than 0° and no more than 90°. Further, the angle θ is desired to be slightly greater than 0° and slightly less than 90°, more specifically, in a range of 20°-60° (20°<θ<60°).

As described above, in this embodiment, the portion 28*a* of the seal 28, which is for keeping sealed the portion of the gap between the cleaning member 6 and cleaning device frame 14, which extends in the lengthwise direction of the cleaning member 6, and the portion 28*b* of the seal 28, which is for keeping sealed the portion of the gap between the cleaning member 6 and cleaning device frame 14, which extends in the widthwise direction of the cleaning member 6, are formed in a single piece, of elastomer. Therefore, this embodiment can reduce the number of the process cartridge manufacture steps. Also in this embodiment, the seal 28 formed of elastomer is subjected by the cleaning member 6, to such reaction force that causes the seal 28 to airtightly press on the bend portion 6*b*1 of the cleaning member 6. Therefore, even if the corner portions of the cleaning device frame 14 and/or bend portion 6*b*1 of the cleaning member 6 are slightly different in shape and/or measurement from their specifications, it is ensured that the portions of the process cartridge (photosensitive drum unit), which correspond in position to the bend portion 6*b*1 of the cleaning member 6 remain satisfactorily sealed.

Further, this embodiment of the present invention was described with reference to the structural arrangement for keeping sealed the unwanted gap between the cleaning device frame 14, and the cleaning member 6 attached to the cleaning device frame 14. However, the structural arrangement, in this embodiment, for the process cartridge (cleaning member and cleaning device frame) is also compatible with a cleaning device, the cleaning member of which is pivotally supported by the frame of the cleaning device, with the same effects as those described above. Next, the structure of a cleaning device 11, which is equipped with the pivotally movable cleaning member 6, is described. The components of this cleaning device 11, which are equivalent to, or the same, in function and structure, as the above described cleaning device 11, are given the same referential codes as those given to the counterparts in the above described cleaning device 11.

Figure 11:
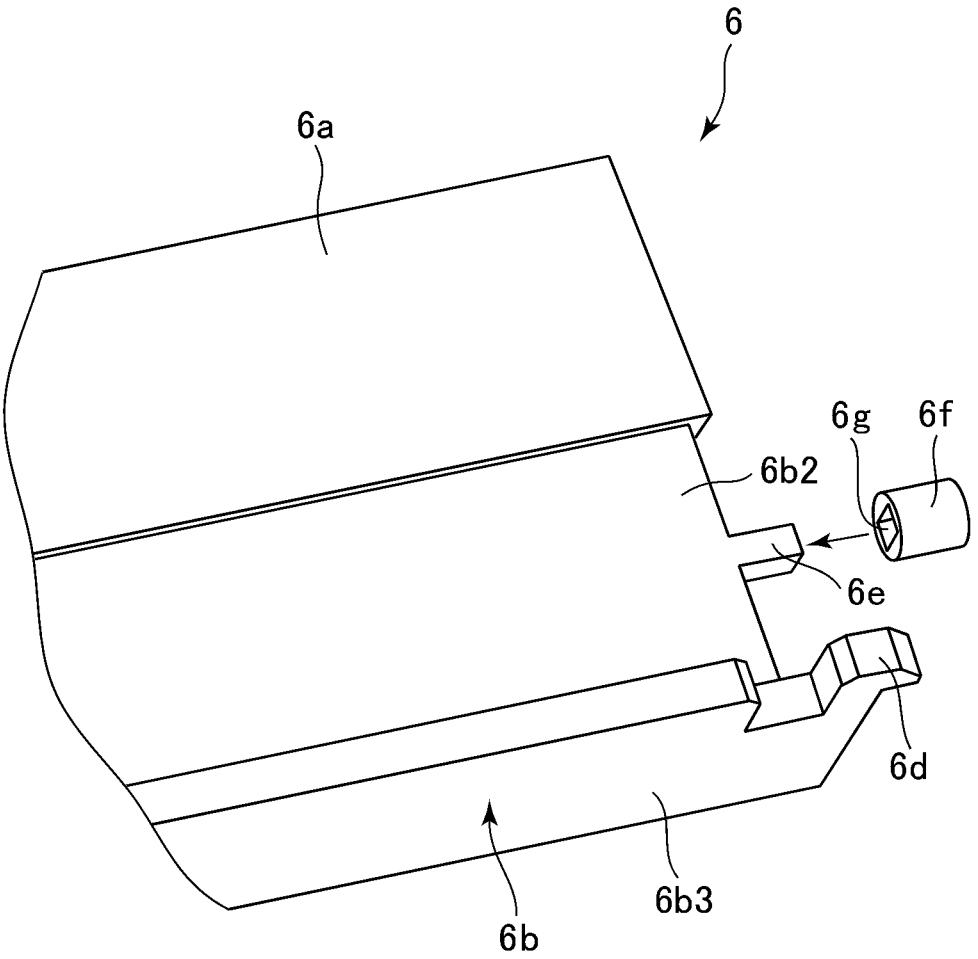
FIG. 11 is a schematic perspective view of one of the lengthwise ends of the pivotally movable cleaning member in the first embodiment of the present invention.

FIG. 11 is a perspective view of one of the lengthwise ends of the cleaning member 6 which are pivotally attached to the cleaning device frame 14. The support portion 6*b* of the cleaning member 6 is provided with a projection 6*c*, which is on the end surface of the first portion 6*b*2 and is parallel to the lengthwise direction of the cleaning member 6. The cleaning member 6 is also provided with a cylindrical portion 6*f*. The cylindrical portion 6*f* is molded of resin, and is provided with a small hole 6*g* (attachment hole) shaped so that a certain portion of the hole 6*g*, in terms of the direction parallel to the axial line of the cylindrical portion 6*f*, is smaller in cross section (diameter) than the projection 6*e*. The cylindrical portion 6*f* is fitted around the projection 6*e*. More specifically, the projection 6*e* is fitted with the cylindrical portion 6*f*. It functions as the axle of the cleaning member 6. The cylindrical portion 6*f* is molded of resin in such a shape that in terms of cross section at a plane parallel to the lengthwise direction of the support portion 6*b*, its small hole 6*g* is smaller in dimension than the projection 6*e*, across the certain range in terms of the direction parallel to its axial line. Therefore, as the projection 6*e* of the support portion 6*b* is pressed into the small hole 6*g* of the cylindrical portion 6*f*, the cylindrical portion 6*f* becomes solidly attached to the projection 6*e*.

Figure 12:
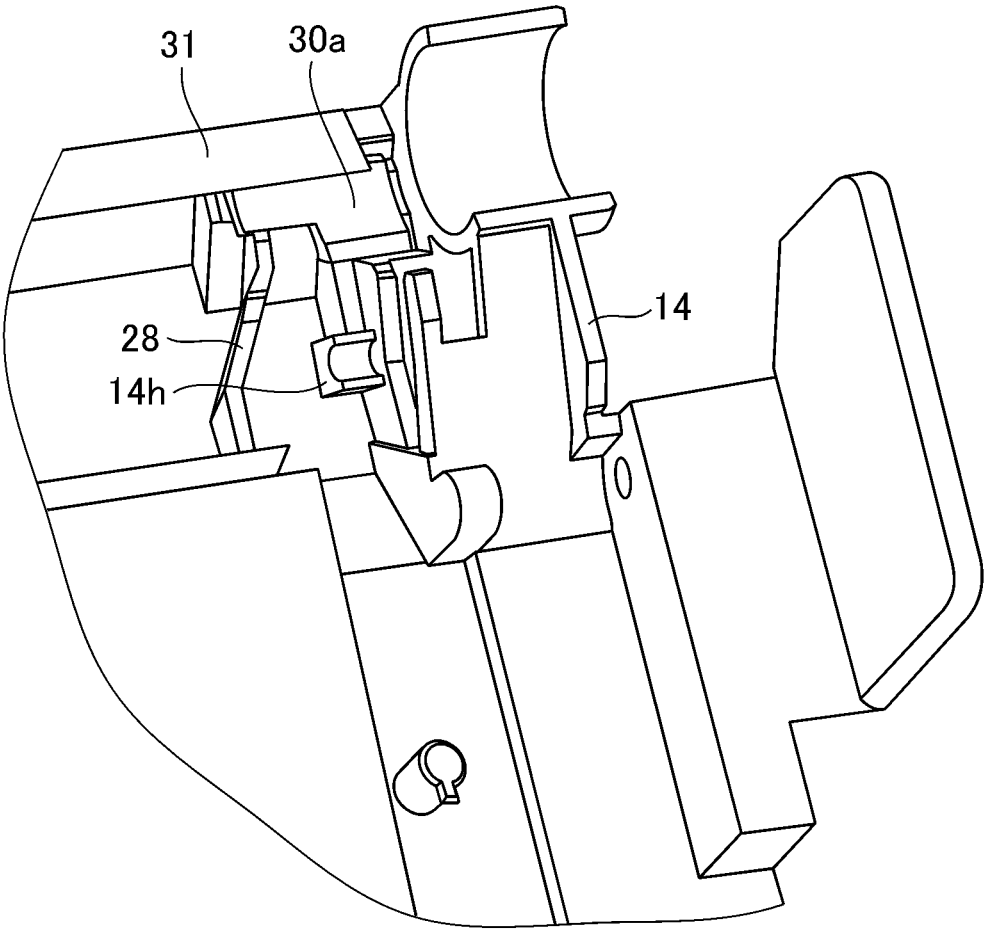
FIG. 12 is a perspective view of one of the lengthwise ends of the cleaning device frame which supports the pivotally movable cleaning member, in the first embodiment of the present invention.

FIG. 12 is a perspective view of one of the lengthwise ends of the cleaning device frame 14, by which the cleaning member 6 is pivotally supported by the cleaning device frame 14. In this modification of the first embodiment, in order to minimize the amount of torque necessary to rotate the photosensitive drum 1, the cleaning member 6 is supported by the cleaning device frame 14 in such a manner that the cleaning member 6 is pivotally movable about the above described shaft (cylindrical portion 6*f*) which extends in the lengthwise direction of the cleaning device frame 14. Further, the cleaning device frame 14 is provided with a support portion 14*h*, which is located at the lengthwise end of the cleaning device frame 14 to rotationally support the cylindrical portion 6*f*. The support portion 14h is U-shaped in terms of the cross section at a plane parallel to the lengthwise direction of the cleaning member 6. That is, the support portion 14*h* is on the inward surface of the cleaning device frame 14, and is perpendicular to the inward surface. It has a cylindrical portion supporting surface (bearing portion), which is U-shaped in cross section at a plane perpendicular to the lengthwise direction of the cleaning device frame 14. This supporting surface faces toward the photosensitive drum 1. The cleaning member 6 is attached to the cleaning device frame 14 in such a manner that its cylindrical portion 6*f* is lowered into the support portion 14*h*. The relationship between the internal diameter of the cylindrical portion bearing surface of the support portion 14*b* and the external diameter of the cylindrical portion 6*f* is such that the cylindrical portion 6*f* smoothly fits into the support portion 14*h*. Thus, as the cylindrical portion 6*f* fits into the cylindrical portion bearing portion of the support portion 14*h*, the cleaning member 6 is supported by the cleaning device frame 14, by its cylindrical portion 6*f* so that the cleaning member 6 is allowed to pivotally move about the cylindrical portion 6*f* In this variation of the first embodiment, the only areas of contact between the cleaning member 6 and cleaning device frame 14 are where the former is pivotally supported by the latter.

Figure 13:
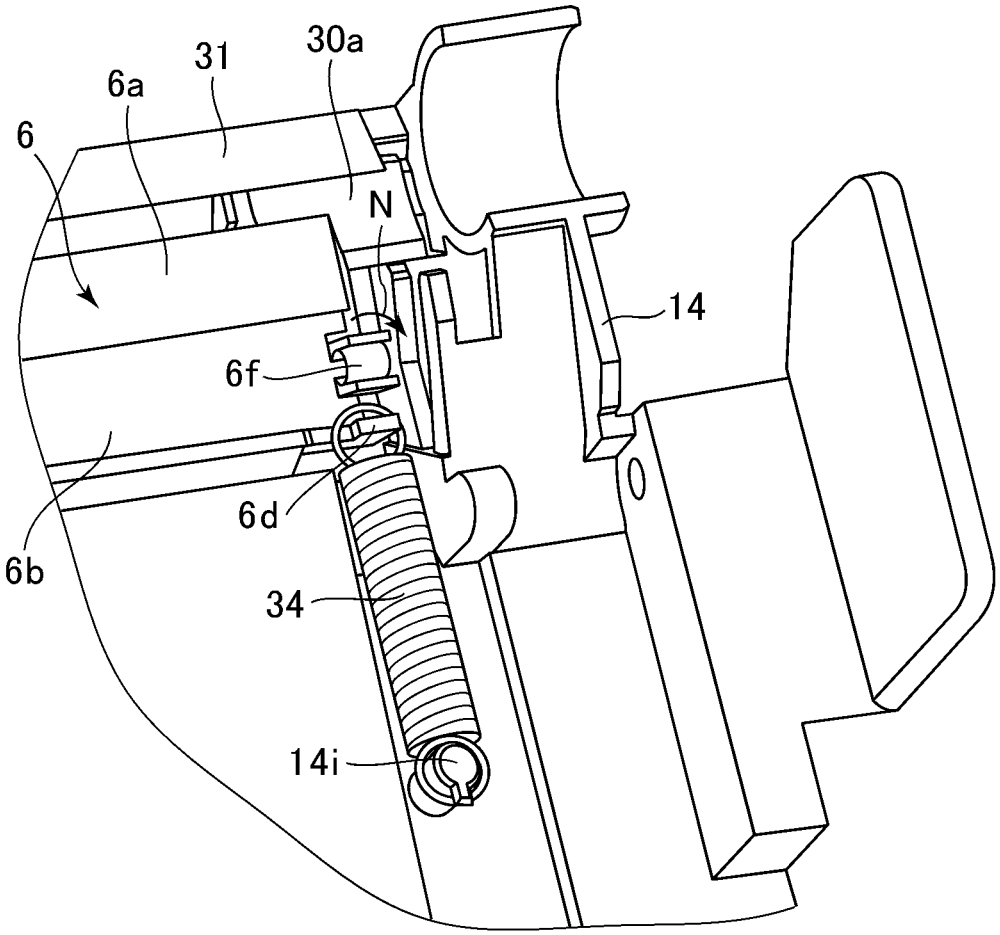
FIG. 13 is a perspective view of one of the lengthwise ends of the photosensitive member unit having the pivotally movable cleaning member in the first embodiment of the present invention.

FIG. 13 is a perspective view of one of the lengthwise ends of the photosensitive member unit 13, to the frame of which the cleaning member 6 is pivotally attached. FIG. 13 does not show the photosensitive drum 1 and charge roller 2. Referring to FIG. 13, the support portion 6*b* of the cleaning member 6 is provided with a spring anchor 6*d*, which projects from the lengthwise end of the support portion 6*b*. More specifically, the spring anchor 6*d* is at the lengthwise end of the second portion 6*b*3 of the support portion 6*b*. That is, the spring anchor 6*d* (to which tension generating member anchoring portion of cleaning member) is located at the lengthwise end of the second portion 6*b*3 of the support portion 6*b*. To describe in detail, a small section of the lengthwise end portion of the support portion 6*b* has been cut away so that the lengthwise end of the second portion 6*b*3 becomes a virtual projection. The tip portion of the spring anchoring portion 6*d* is provided with a thumb nail-like portion to which one of the lengthwise ends of the tension spring 34 is anchored. As described above, in this variation of the first embodiment, the tension spring 34 keeps pulled the force bearing portion (spring anchor portion 6*d*), which projects toward the photosensitive drum 1, in the direction intersectional to the first portion 6*b*2 of the support portion 6*b*. As for the cleaning device frame 14, it is provided with a hook-like portion 14*i*, to which the tension spring 34 is anchored. In this variation of the first embodiment, the hook-like portion 14*i* (tension generation member anchoring portion) is a roughly cylindrical projection which perpendicularly projects from the inward surface of the cleaning device frame 14. The tip portion of the hook-like portion 14*i* is provided with a tension roller anchoring portion, which looks like a thumb nail. As one end of the tension spring 34 is anchored to the anchoring portion 6*d*, and the other end of the tension spring 34 is anchored to the hook-like portion 14*i*, the cleaning member 6 is subjected to the tensional force of the tension spring 34. Thus, the cleaning member 6 pivotally moves about the cylindrical portion 6*e* (6*f*) in the direction indicated by an arrow mark N in the drawing. That is, in the case of this structural arrangement, the cleaning member 6 pivotally moves about the lengthwise end of the first portion 6*b*2 of the supporting portion 6*b*. Thus, the cleaning member 6 is kept in contact with the peripheral surface of the photosensitive drum 1 by a preset amount of force generated by the tension spring 34, which causes the cleaning member 6 to pivotally move in the direction N.

Figure 14:
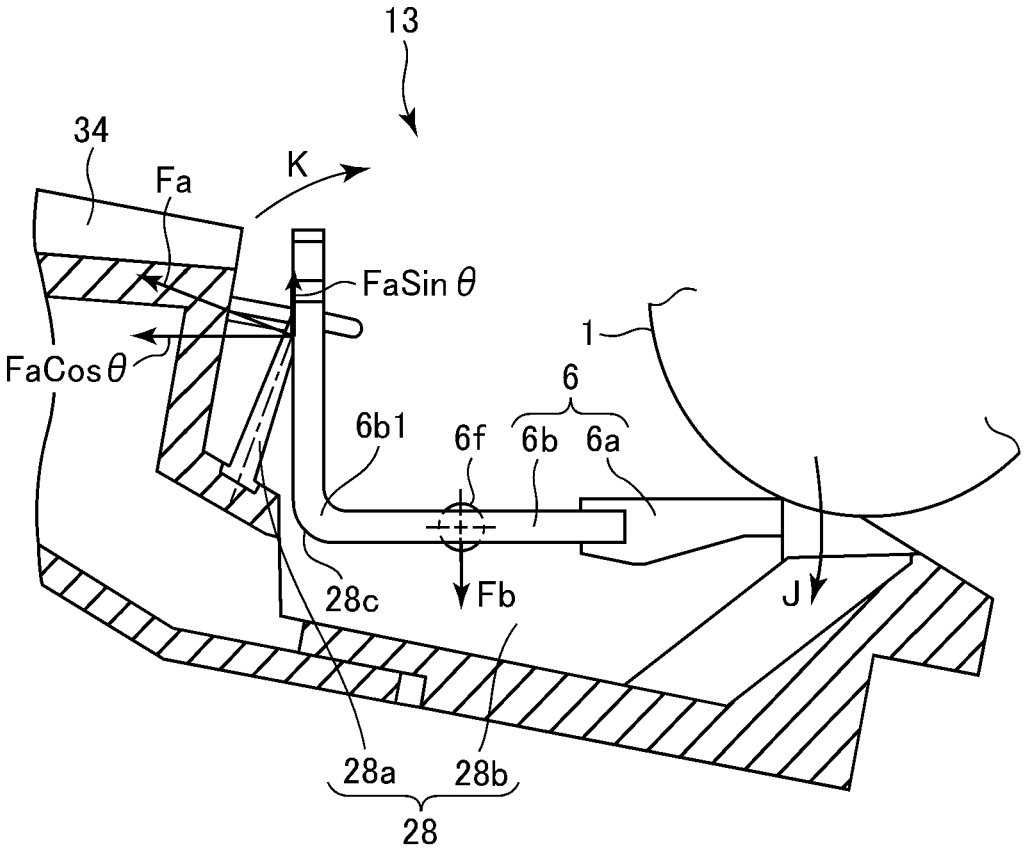
FIG. 14 is a schematic sectional view of a part of the photosensitive member unit having the pivotally movably cleaning member, in the first embodiment of the present invention.

FIG. 14 is a sectional view of the photosensitive member unit 13 after the attachment of the pivotally movable cleaning member 6 to the photosensitive member unit frame. The seal 28 of the photosensitive member unit 13 in this variation is the same in structure as the one in the first embodiment. Therefore, it is not described here. Also in the case of the structure of this variation, the corner portion 28*c* of the seal 28, which faces the bend portion 6*b*1 of the support portion 6*b* of the cleaning member 6 is pulled by the force FaSinθin the vertically upward in the drawing, and also, in the vertically downward by the force Fb.

Therefore, even if the bend portion 6*b* of the support portion 6*b* is slightly different in measurement from its specification and/or the corner portion 28*c* of the seal 28 is different in shape from its specification, it is ensured that the seal 28 remains airtightly in contact with the bend portion 6*b*1 of the support portion 6*b*.

Further, in the case of the photosensitive member unit 13 in the this variation of first embodiment, which is structured as described above, if the elastic portion 6*a* of the cleaning member 6 pivotally moves about the cylindrical portion 6*f* in the direction indicated by an arrow mark J in the drawing due to the vibration of the photosensitive drum 1 or the like, the support portion 6*b* pivotally moves about the cylindrical portion 6*f* in the direction indicated by an arrow mark K in the drawing. Even in such a case such this one, the corner portion 28*c* of the seal 8 deforms in such a manner that it presses upon the bend portion 6*b*1, ensuring even more that the interface between the bend portion 6*b*1 and the portion 28*c* of the seal 28 remains airtightly sealed.

In the case of the structural arrangement for the photosensitive member unit 13 in this variation of the first embodiment, the cylindrical portion 6*f* was attached to the supporting portion 6*e*. However, the present invention is also applicable to a photosensitive member unit structured so that it cleaning member is pivotally moved in a manner that is different in this variation of the first embodiment, as effectively as it is applicable to the photosensitive member unit 13 in this embodiment. For example, the present invention is also applicable to a photosensitive member unit (13), the support portion itself of the cleaning member 6 of which is cylindrical, or a photosensitive member unit (13), the axle portion of which is a cylindrical member attached to the supporting portion. Further, the first embodiment of the present invention, and the above described variation of the first embodiment are not intended to limit the present invention in terms of the shape, in cross section, of the cleaning member bearing surface of the cleaning member bearing of the cleaning device frame 14. That is, the application of the present invention is not limited to a photosensitive member unit, the shape, in cross section, of the cleaning member bearing surface of the cleaning member bearing of which is U-shaped. For example, the present invention is also applicable to a photosensitive member unit (13), the shape, in cross section, of the cleaning member bearing surface of the cleaning member bearing of the cleaning device frame 14, by which the pivot (shaft) is borne is roughly cylindrical. Further, the first embodiment and the above described variation of the first embodiment are not intended to limit the choice of the means for keeping the cleaning member 6 in contact with the peripheral surface of the photosensitive drum 1, to the tension spring. For example, the present invention is also applicable to a photosensitive member unit structured so that a compression spring is placed, as the means for generating the force for keeping the cleaning member 6 in contact with the peripheral surface of the photosensitive drum 1, between the seat of the pressure generating member anchoring portion of the photosensitive member unit frame and the pressure generating member anchoring portion of the support portion of the cleaning member. In such a case, the compression spring as a pressure generating member, causes the cleaning member to pivotally move about the cleaning member axle, which extends in the lengthwise direction (first direction) of the cleaning member, in the direction to place the elastic portion of the cleaning member in contact with the peripheral surface of the image bearing member.

(Embodiment 2)

Next, another embodiment of the present invention is described. The cleaning device, process cartridge, and electrophotographic image forming apparatus in this embodiment are the same in basic structure as the counterparts in the first embodiment.

Therefore, the components of the cleaning device, process cartridge, and electrophotographic image forming apparatus, which are the same in function and structure as the counterparts in the first embodiment, are given the same referential codes as those given to the counterparts in the first embodiment, and are not described in detail, here.

Figure 15:
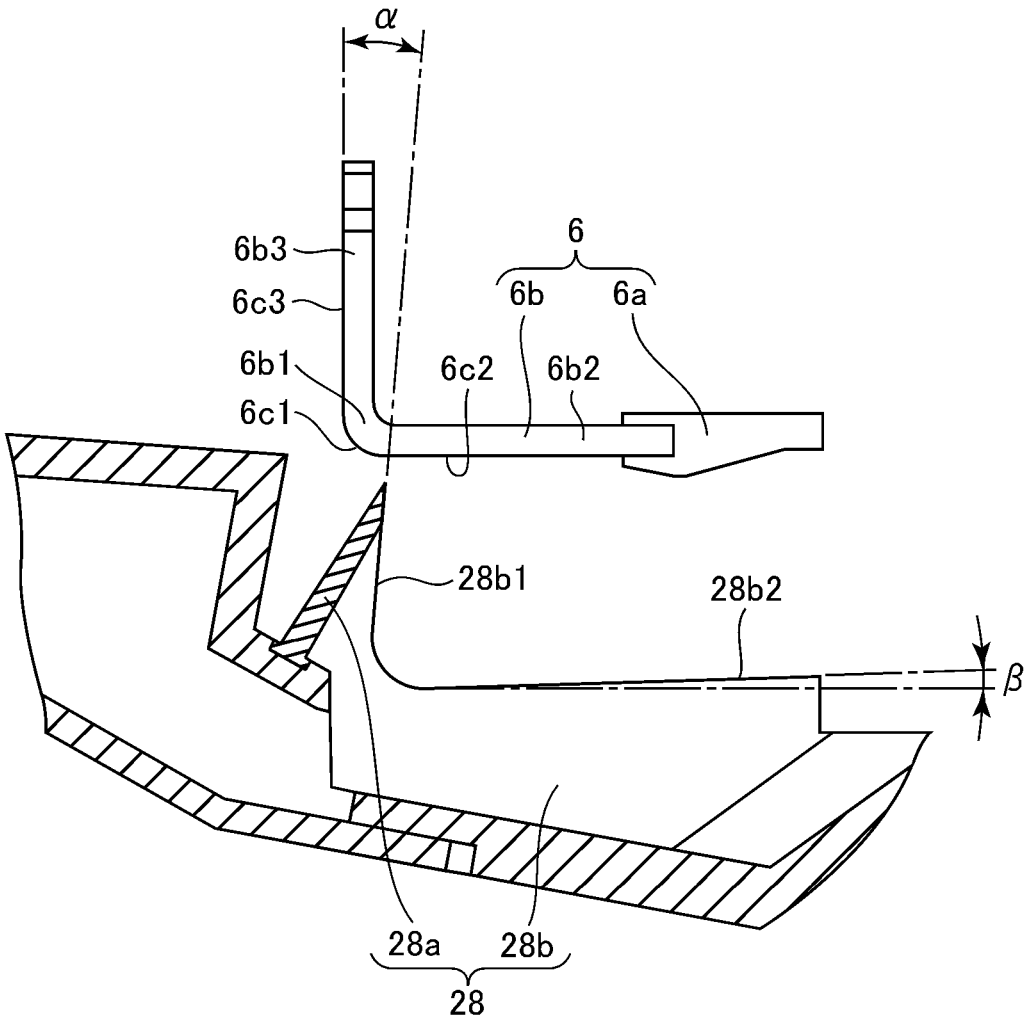
FIG. 15 is a schematic sectional view of the seal for the cleaning device frame in the second embodiment of the present invention.

FIG. 15 is a schematic sectional view of the photosensitive member unit 13 immediately before the attachment of the seal 18 to the pivotally movable cleaning member 6 (FIGS. 11-14). Referring to FIG. 15, the first portion 28*b* of the seal 28, which is for keeping sealed the portion of the gap between the cleaning member 6 and cleaning device frame 14, which extends in the lengthwise direction of the cleaning member 6, has slanted surfaces 28*b*1 and 28*b*2, which are slanted in such a manner that the farther from where the seal 28 faces the bend portion 6*b*1 of the cleaning member 6, in terms of the widthwise direction of the cleaning device frame 14, the greater the amount by which the seal 28 is deformed by its contact with the cleaning member 6. The slanted surfaces 28*b*1 and 28*b*2 are tilted relative to the contact areas (second surface 6*c*3 and first surface 6*c*2, respectively) of the support portion 6*b*, at angles α and β, respectively.

That is, the first portion 28*b* of the seal 28 has the first and second slanted surfaces 28*b*2 and 28*b*1. The first slanted surface 28*b*2 is slanted so that the farther it is from the bend portion surface 6*c*1 toward the first surface, in the direction perpendicular to the above described first direction (lengthwise direction), the greater the amount by which the seal 28 is deformed by the contact between the cleaning member 6 and seal 28, which occurs when the cleaning member 6 is attached to the cleaning device frame 14. The second slanted surface 28*b*1 is slanted so that the farther it is from the bend portion surface 6*c*1 toward the second surface, in the direction perpendicular to the above described first direction (lengthwise direction), the greater the amount by which the seal 28 is deformed by the contact between the cleaning member 6 and seal 28, which occurs when the cleaning member 6 is attached to the cleaning device frame 14.

Figure 16:
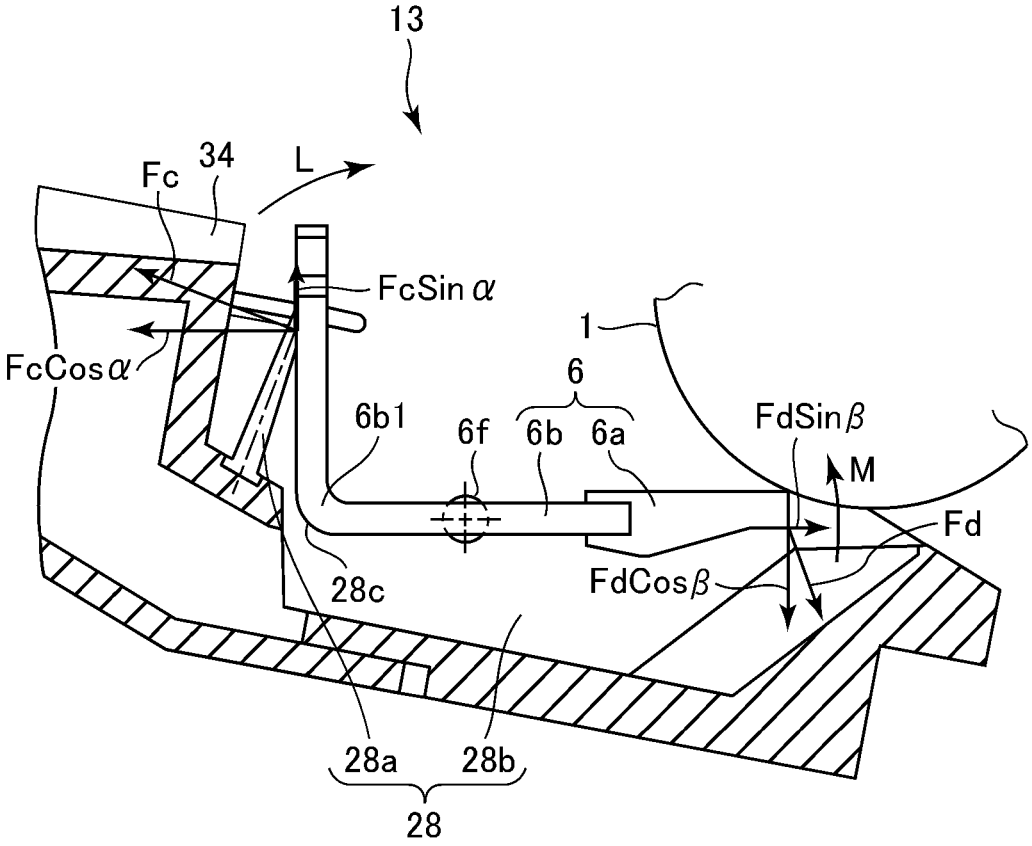
FIG. 16 is a schematic sectional view of the cleaning device frame, cleaning member, and cleaning device seal, in the second embodiment of the present invention.

FIG. 16 is a sectional view of the cleaning member 6, seal 8, and their adjacencies after the attachment of the cleaning member 6 to the photosensitive member unit frame 13. Referring to FIG. 16, as the cleaning member 6 is attached to the cleaning device frame 14, the second slanted surface 28*b*1 is subjected to a reaction force Fc by the support portion 6*b*, and the first slanted surface 28*b* is subjected to a reaction force Fd by the elastic portion 6*a*. At the same time, the second slanted surface 28*b*1 is subjected to a force Fc Sin α, which is the vertical component (in FIG. 16) of the reaction force Fc, and also, a force Fc Cos α, which is the horizontal component (in FIG. 16) of the reaction force Fc. Further, the first slanted surface 28*b*2 is subjected to a force FdCos β, which is the vertical component (FIG. 16) of the reaction force Fd, and a force Fd Sin β, which is the horizontal component (FIG. 16) of the reaction force Fd. That is, the corner portion 28*c* of the seal 28, which faces the bend portion 6*b*1 of the support portion 6*b* are pulled by both the component of the reaction force Fc, and the component of the reaction force Fd.

As the cleaning member 6 pivotally supported by the cleaning device frame 14 pivotally moves in the direction L to move away from the slanted surface 28*b*1, the force Fc reduces, whereas the force Fd increases. On the other hand, as the cleaning member 6 pivotally moves in the direction M to move away from the slanted surface 28*b*2, the force Fd reduces, whereas the force Fc increases. Thus, setting the angles α and β so that the amount by which the force Fc increases or decreases matches the amount by which the force Fd decreases or increases, respectively, can ensure that the corner portion 28*c* of the seal 28, which faces the bend portion 6*b*1 of the support portion 6*b*, is pulled by a preset amount of force. In this embodiment, the angles α and β are set to be no less than 0° and no more than 45° ($0° < \alpha, \beta < 45°$).

As described above, this embodiment can ensure that waste toner does not leak through the gap between the bend portion 6b1 of the support portion 6b of the cleaning member 6 and the cleaning device frame 14, even in a case where a pivotally movable cleaning member is employed.

The structural arrangement, in this embodiment, which is for the cleaning device of a process cartridge, and provides the seal 28 with the slanted surfaces 28b2 and 28b1, is applicable to a case in which a cleaning member is to be solidly attached to the cleaning device frame. Such an application can more reliably prevent waste toner from leaking through the gap between the bend portion 6b1 of the support portion 6b and seal 28. Also in such a case, the angles $\alpha$ and $\beta$ are desired to be in a range of 0°-45° ($0° < \alpha, \beta < 45°$).

(Miscellanies)

The present invention was described with reference to the embodiments of the present invention. However, these embodiments are not intended to limit the present invention in scope.

For example, in the embodiments described above, the cleaning device was for removing the toner on the photosensitive drum as an image bearing member. However, these embodiments are not intended to limit the present invention in terms of an apparatus (device) to which the present invention is applicable. For example, the present invention is applicable to the intermediary belt cleaning device 11 as an image bearing member, or the like, to remove the toner on the intermediary transfer member. Further, the present invention is applicable to any cleaning apparatus (device) for removing the toner to be removed, from an image bearing member. For example, the present invention is also applicable to a cleaning apparatus (device) for removing a control image formed of toner, on a recording medium bearing member, the toner left unintendedly on the recording medium bearing member, etc.

INDUSTRIAL APPLICABILITY

As will be evident from the above given description of the present invention, the present invention can more easily and more reliably keep sealed the gaps which are present along the length and widthwise edges of the cleaning member than any prior art, even if the components of the photosensitive member unit are slightly different in shape and measurement from their specification.

While the invention has been described with reference to the structures disclosed herein, it is not confined to the details set forth, and this application is intended to cover such modifications or changes as may come within the purposes of the improvements or the scope of the following claims.

The invention claimed is:

1. A cleaning device for use with an image forming apparatus, said cleaning device comprising;

a frame;

a cleaning member, mounted to said frame, for removing a developer from a surface of an image bearing member, said cleaning member including a blade member contactable to the surface of the image bearing member and a supporting member supporting said blade member, said supporting member including a first flat surface, a second flat surface extending in a direction crossing with said first flat surface, and a bent portion connecting said first flat surface and said second flat surface over an entire longitudinal area of said supporting member, said blade member extending along a longitudinal direction of said supporting member at an end portion of said first flat surface opposite from said bent portion with respect to a direction crossing with the longitudinal direction; and a sealing member of sealing resin material provided between said cleaning member and said frame, said sealing member including a seal portion sealing between said second flat surface and said frame, wherein said seal portion extends from said frame and contacts said second flat surface, and includes an inclination at an angle having a component parallel with said first flat surface and a component parallel with said second flat surface, in a section perpendicular to the longitudinal direction.

2. A cleaning device according to claim 1, wherein said sealing member has such a configuration that deformation thereof by mounting said cleaning member to said frame increases toward an end portion of said first flat surface and an end portion of said second flat surface from said bent portion along the crossing direction.

3. A cleaning device according to claim 1, wherein said cleaning member is rotatably supported by said frame.

4. A cleaning device according to claim 1, wherein said sealing member is integrally molded with said frame.

5. A cleaning device according to claim 1, wherein a second flat surface side end of said seal portion is contacted to said second flat surface with the inclination from said bent portion toward an end portion of said second flat surface in the section perpendicular to the longitudinal direction.

6. A cleaning device according to claim 5, wherein an angle $\theta$ between said seal portion and said second flat surface satisfies $0° < \theta < 90°$.

7. A cleaning device according to claim 5, wherein an angle $\theta$ between said seal portion and said second flat surface satisfies $20° < \theta < 60°$.

8. A cleaning device according to claim 1, wherein the longitudinal direction is parallel with an axial direction of the image bearing member.

9. A process cartridge detachably mountable to a main assembly of an image forming apparatus, comprising:

an image bearing member;

a frame;

a cleaning member, mounted to said frame, for removing a developer from a surface of an image bearing member, said cleaning member including a blade member contactable to the surface of the image bearing member and a supporting member supporting said blade member, said supporting member including a first flat surface, a second flat surface extending in a direction crossing with said first flat surface, and a bent portion connecting said first flat surface and said second flat surface over an entire longitudinal area of said supporting member, said blade member extending along a longitudinal direction of said supporting member at an end portion of said first flat surface opposite from said bent portion with respect to a direction crossing with the longitudinal direction; and a sealing member of sealing resin material provided between said cleaning member and said frame, said sealing member including a seal portion sealing between said second flat surface and said frame, wherein said seal portion extends from said frame and contacts said second flat surface, and includes an inclination at an angle having a component parallel with said first flat surface and a component parallel with said second flat surface, in a section perpendicular to the longitudinal direction.

10. A process cartridge according to claim 9, wherein said sealing member has such a configuration that deformation thereof by mounting said cleaning member to said frame increases toward an end portion of said first flat surface and an end portion of said second flat surface from said bent portion along the crossing direction.

11. A process cartridge according to claim 9, wherein said cleaning member is rotatably supported by said frame.

12. A process cartridge according to claim 9, wherein said sealing member is integrally molded with said frame.

13. A process cartridge according to claim 9, wherein a second flat surface side end of said seal portion is contacted to said second flat surface with the inclination from said bent portion toward an end portion of said second flat surface in the section perpendicular to the longitudinal direction.

14. A process cartridge according to claim 13, wherein an angle θ between said seal portion and said second flat surface satisfies $0°<\theta<90°$.

15. A process cartridge according to claim 13, wherein an angle θ between said seal portion and said second flat surface satisfies $20°<\theta<60°$.

16. A process cartridge according to claim 9, wherein the longitudinal direction is parallel with an axial direction of the image bearing member.

17. An image forming apparatus for forming an image on a recording material, said image forming apparatus comprising:

(i) an image bearing member;

(ii) a cleaning device including:

a frame;

a cleaning member, mounted to said frame, for removing a developer from a surface of said image bearing member, said cleaning member including a blade member contactable to the surface of said image bearing member and a supporting member supporting said blade member, said supporting member including a first flat surface, a second flat surface extending in a direction crossing with said first flat surface, and a bent portion connecting said first flat surface and said second flat surface over an entire longitudinal area of said supporting member, said blade member extending along a longitudinal direction of said supporting member at an end portion of said first flat surface opposite from said bent portion with respect to a direction crossing with the longitudinal direction; and a sealing member of sealing resin material provided between said cleaning member and said frame, said sealing member including a seal portion sealing between said second flat surface and said frame, wherein said seal portion extends from said frame and contacts said second flat surface, and includes an inclination at an angle having a component parallel with said first flat surface and a component parallel with said second flat surface, in a section perpendicular to the longitudinal direction; and (iii) feeding means for feeding the recording material.

18. An apparatus according to claim 17, wherein said sealing member has such a configuration that deformation thereof by mounting said cleaning member to said frame increases toward an end portion of said first flat surface and an end portion of said second flat surface from said bent portion along the crossing direction.

19. An apparatus according to claim 17, wherein said cleaning member is rotatably supported by said frame.

20. An apparatus according to claim 17, wherein said sealing member is integrally molded with said frame.

21. An apparatus according to claim 17, wherein a second flat surface side end of said seal portion is contacted to said second flat surface with the inclination from said bent portion toward an end portion of said second flat surface in the section perpendicular to the longitudinal direction.

22. An apparatus according to claim 21, wherein an angle θ between said seal portion and said second flat surface satisfies $0°<\theta<90°$.

23. An apparatus according to claim 21, wherein an angle θ between said seal portion and said second flat surface satisfies $20°<\theta<60°$.

24. An apparatus according to claim 17, wherein the longitudinal direction is parallel with an axial direction of said image bearing member.

* * * * *